US010596397B2

(12) United States Patent
Gross et al.

(10) Patent No.: US 10,596,397 B2
(45) Date of Patent: Mar. 24, 2020

(54) HARNESS CONFIGURATIONS FOR A SUSPENSION DEVICE

(71) Applicant: SkySaver Rescue Ltd., Jerusalem (IL)

(72) Inventors: Baruch Eliezer Gross, Petah Tikva (IL); Avner Farkash, Yakir (IL); Israel Daniel Minehart, Beitar Illit (IL); Sasson Betzalel, Jerusalem (IL)

(73) Assignee: SKYSAVER RESCUE LTD., Jerusalem (IL)

( * ) Notice: Subject to any disclaimer, the term of this patent is extended or adjusted under 35 U.S.C. 154(b) by 39 days.

(21) Appl. No.: 15/715,422

(22) Filed: Sep. 26, 2017

(65) Prior Publication Data

US 2018/0015311 A1 Jan. 18, 2018

Related U.S. Application Data

(63) Continuation of application No. 14/624,856, filed on Feb. 18, 2015, now Pat. No. 9,802,067.

(51) Int. Cl.
*A62B 35/00* (2006.01)
*A62B 1/10* (2006.01)

(52) U.S. Cl.
CPC ..... *A62B 35/0025* (2013.01); *A62B 1/10* (2013.01); *A62B 35/0018* (2013.01); *A62B 35/0093* (2013.01)

(58) Field of Classification Search
CPC ..... A62B 35/0018; A62B 35/0025; A62B 35/0031
See application file for complete search history.

(56) References Cited

U.S. PATENT DOCUMENTS

| | | | |
|---|---|---|---|
| 484,042 | A | 10/1892 | Murphy |
| 1,842,611 | A | 1/1932 | Irvin |
| 2,175,748 | A | 10/1939 | Dunn |
| 2,462,234 | A | 2/1949 | Supina |

(Continued)

FOREIGN PATENT DOCUMENTS

| | | | |
|---|---|---|---|
| CN | 2230690 | U | 5/2012 |
| DE | 4224334 | A1 | 1/1994 |

(Continued)

OTHER PUBLICATIONS

International Search Report in corresponding International Appl. No. PCT/IL2016/050191 dated May 9, 2016.

(Continued)

*Primary Examiner* — Colleen M Chavchavadze
(74) *Attorney, Agent, or Firm* — Browdy and Niemark, PLLC

(57) ABSTRACT

A harness system for harnessing a user to a suspension device. The harness comprises a strap system having a plurality of straps configured and operable to connect the suspension device to a back region of the harness, each strap having a back end portion at said back region and connectable to the suspension device, and a front end portion located in a front side of the harness. The straps extend from the back region to the front side of the harness and wrap around all sides of a torso of said user. A single connector assembly is used for quick connection of front end portions of at least some of the straps at the front side of the harness in a single interlocking operation, thereby to secure the harness to the user.

21 Claims, 19 Drawing Sheets

(56) References Cited

U.S. PATENT DOCUMENTS

| | | | | |
|---|---|---|---|---|
| 2,979,028 | A | 4/1961 | Zakely | |
| 3,258,231 | A | 6/1966 | Basnett | |
| 3,760,901 | A | 9/1973 | Hynes | |
| 3,973,643 | A | 8/1976 | Hutchinson | |
| 4,063,615 | A | 12/1977 | Knepp | |
| 4,302,049 | A * | 11/1981 | Simpson | A44B 11/2526 24/632 |
| 4,533,017 | A | 8/1985 | Litchfield | |
| 4,682,390 | A | 7/1987 | Parrish | |
| 4,877,110 | A | 10/1989 | Wolner | |
| 4,927,211 | A | 5/1990 | Bolcerek | |
| 5,027,833 | A | 7/1991 | Calkin | |
| 5,329,884 | A | 7/1994 | Bell | |
| 5,960,480 | A | 10/1999 | Neustater et al. | |
| 6,378,465 | B1 | 4/2002 | Austin | |
| 6,962,235 | B2 | 11/2005 | Leon | |
| 7,086,091 | B2 * | 8/2006 | Jordan | A41D 13/0007 2/69 |
| 7,353,779 | B2 | 4/2008 | Altieri | |
| 7,610,641 | B2 | 11/2009 | Frost | |
| 8,177,025 | B2 * | 5/2012 | Lang | A62B 35/0018 182/3 |
| 8,356,692 | B1 | 1/2013 | Steck et al. | |
| 8,902,074 | B2 * | 12/2014 | Landry | G08B 25/016 182/3 |
| 2004/0088794 | A1 | 5/2004 | Calkin | |
| 2004/0112674 | A1 | 6/2004 | Yerman | |
| 2004/0128734 | A1 | 7/2004 | Jordan | |
| 2004/0245048 | A1 | 12/2004 | Ribic | |
| 2008/0156583 | A1 | 7/2008 | Meeks | |
| 2010/0122874 | A1 | 5/2010 | Harris, Jr. | |
| 2013/0249204 | A1 | 9/2013 | Fink | |
| 2016/0089554 | A1 * | 3/2016 | Perner | A62B 35/0006 182/3 |

FOREIGN PATENT DOCUMENTS

| | | | |
|---|---|---|---|
| EP | 0508278 | A1 | 10/1992 |
| GB | 1039267 | A | 8/1966 |
| GB | 2230690 | | 4/1989 |
| WO | 0047098 | A1 | 8/2000 |
| WO | 03055560 | A1 | 7/2003 |
| WO | 2004/075991 | A2 | 9/2004 |
| WO | 2009/122397 | A2 | 10/2009 |

OTHER PUBLICATIONS

SkySaver: "SkySaver Rescue Device" , YouTube, Feb. 9, 2015 (Feb. 9, 2015), p. 1, XP054978774, Retrieved from the Internet: URL:https://www.youtube.com/watch?v=sainfHf5H8 [retrieved on Oct. 12, 2018] *0.23-0.27min *.

Screenshot captures from YouTube video entitled SkySaver: "SkySaver'Rescue Device" , Youtube, Feb. 9, 2015 (Feb. 9, 2015), p. 1, XP054978774, Retrieved from the Internet: URL:https://www.youtube.com/watch?r=sainfHf5H8 [retrieved on Oct. 12, 2018] *0.23-0.27min *.

* cited by examiner 6
66
66p
C4
65
C4
65s
66p
6t
C8
6g
6t
6b
C9
65b
C8
5s
6u
C3
66b
C7
C3
C7
UL
65w
UL
C5
63
6d
C1
C1
6w
6q
8f
LL
C2
C2
LL
P
6e
6e
6y
6h
6y
8f
6c C6
67
8c

HARNESS CONFIGURATIONS FOR A SUSPENSION DEVICE

TECHNOLOGICAL FIELD

The present invention is generally in the field of harnessing systems usable for suspension and controlled descent devices.

BACKGROUND

In today's urban environments, many people live or work in multi-storied buildings such as sky-scrapers. In case of a fire or terrorist attack, rapid descent from upper floors of such buildings may be necessary. In such emergency situations, use of an elevator may be unsafe. Emergency stairwells may become blocked by fire or smoke, making rapid escape difficult. Descent devices may be used in such emergency situations to allow a rescue to be safely lowered to the ground.

A serious concern in Controlled Descent Device (CDD) design involves prevention of suspension trauma which may occur if the rescuee remains suspended in a safety harness after an arrested fall. Suspension trauma may cause serious injuries and even death, due to interruption of blood flow to and from the lower extremities of the rescuee's body caused by pressure applied by the leg straps over the arteries and veins of the upper leg and groin region of the rescuee.

Some controlled descent devices known from the patent literature are briefly described below.

U.S. Pat. No. 3,760,901 describes a lifesaving system for escaping from high buildings using a descending bar coupled to the upper part of a window and which projects outwardly, or is coupled to a fixed point of a place a user wishes to escape the building from. A harness or belt snugly surrounds a part of the body of the user, and a hermetically closed element, that has an assembly of wheels coupled to each other in its interior, is joined by a part to the harness or belt, and therefore to the user, and is also joined by another part, such as a hook, to the descending bar when the user to be rescued leaves the building by descending vertically.

US Patent publication No. 2004245048 describes a rappelling device for permitting persons to be rescued from high buildings, towers, and the like, having a suspension strap, suspension vest, or the like, to be worn by the person in question, wherein a rope container having a device to release the rope length is provided on the suspension strap, which solution is supposed to be easy to operate, on the one hand, and to be made available to the persons in question at any time, and easy to handle for them, whereby the person using the device can essentially move both hands freely, in a stable rappelling position. This is achieved in that the rope drum that forms the rope container, in the wearing position on the back of the person using the device, is provided with a rope guide device for passing the rope to a release position in the chest region of the person using the device.

International Patent Publication No. WO 03/055560 discloses an abseiling device used as rescue equipment in disaster situations, particularly fires in buildings or tall buildings, comprising a harness for supporting particularly a person, a housing provided with a rope drum and an automatic braking device, and a rope, one end of which is fixed to the building and the other end of which is fixed to the housing. The housing is connected to the harness so as to form a unit.

U.S. Pat. No. 4,063,615 describes an escape device which includes a housing from which the user of the device is supported. The housing journals a drum about which a cable is coiled. During use of the device the free end of the cable is secured to a building part while the user being supported by the housing descends to the ground. A braking mechanism is incorporated in the housing to regulate the rate of descent of the housing and supported user.

US Patent No. US 2010/122874 describes a self-rescue system and a method for providing self-rescue to fall-victims suspended in fall-arresting safety harnesses following an accidental fall enables such suspended fall victims to descend to the ground or other place of safety at a controlled, safe velocity, without assistance from anyone else. In addition, the invention can also address applications in many types of elevated locations where a controlled descent is needed in order to escape emergency conditions.

GENERAL DESCRIPTION

There is a need in the art for harness systems capable of quickly harnessing a user to a suspension device (e.g., parachute, controlled descent device, and suchlike), and effectively prevent suspension trauma risks. The present invention provides harnessing system configurations designed to wrap the torso of the user being harnessed from all sides (waist, bottom and top), and to establish connection between various straps of the harness at a front side (e.g., abdomen area) of the harness by a single connector assembly, to thereby secure the harness to the user. The harness configurations disclosed herein are designed to provide a back suspension area and maintain the body of the harnessed user in a predetermined desired position/posture (e.g., vertical or reclining position), and/or orientation, while being suspended.

The terms horizontal, vertical, back and front, used herein to refer to elements/parts of the harness, are meant to be relative to the body of the harnessed user in an upright or reclining position.

In some embodiments, a back end portion of the straps wrapping the torso of the user from all sides are located at a back region of the harness and are connectable to the suspension device, thereby defining the suspension area of the harness. The straps extend from the back region along the user's torso to its front side where front end portions of the straps are connected to each other. The connection of the straps at the front side of the harness is established using permanent connecting means (e.g., stitching, welding, adhesion, rivets/bolts), adjustable connecting means (e.g., buckles), and/or by a quick connector assembly (e.g., quick-connect chest buckle interlock).

The straps of the harness may be divided into an upper straps assembly, comprising straps configured to wrap upper and lateral sides of the user's torso, and a lower straps assembly, comprising straps configured to wrap the lower side of the user's torso. Preferably, the lower assembly is connected to the upper assembly by the quick connector assembly, thereby forming two leg loops of the harness. Optionally, and in some embodiments preferably, straps of the upper assembly are connected to each other at the front side of the harness using the permanent and/or the adjustable connecting means, and form two shoulder loops configured to receive the shoulders' of the user being harnessed.

For example, the upper assembly may comprise two spaced apart shoulder straps extending from the back region towards the front side of the harness and configured to wrap around the user's shoulders, and two abdomen straps extending in opposite directions from the sides of the back region towards the front side and configured to wrap around the user's waist. Preferably, each shoulder strap is connected (e.g., by permanent or adjustable connecting means) to a respective abdomen strap at the front side of the harness, thereby forming one shoulder loop of the harness. An adjustment strap may be used to connect each shoulder strap to its respective abdomen strap using a size adjustment buckle. The lower assembly may comprise two spaced apart crotch straps extending from a bottom side of the back region towards the front side of the harness, where the front end portions of the crotch straps are connected to each other (e.g., by permanent connecting means), thereby forming a V-shaped strap structure.

The harness may comprise intermediary straps configured and operable to connect between the lower strap assembly and the upper strap assembly and/or the suspension device. For example, the harness may comprise two intermediary straps, each extending from a bottom side of the back region towards the front side of the harness, and having a back end portion connectable to the suspension device, a front end region connectable to the upper straps assembly at the front side of the harness, and a portion between said back and front end portions connectable to the lower strap assembly. In some embodiments, each intermediary strap is configured to form a V-shape structure having an apex configured to connect to the lower straps assembly.

The connector assembly may comprise two connecting elements associated in the upper straps assembly, each element associated with one of the abdomen straps, and an additional connecting element provided in the lower straps assembly and associated with the apex of the V-shaped structure of the crotch straps. For example, adjustable connecting means may be used to connect a connecting element to each abdomen strap and a further connecting element to the apex formed by the crotch straps. The connecting elements are designed to establish connection between them in a single interlocking/latching operation. For example, and without being limiting, the connecting elements of the abdomen straps may be female connectors, and the connector element of the crotch straps may be a male connector (e.g., T-bar) configured to mate and establish secure connection with the two female connectors.

Some embodiments of the harness may be used for implementing a wearable controlled descent device (CDD) usable for rescuing a user escaping from a high structure (e.g., a multi-storied building or other high location such as a bridge, oil rig, tree or the like), by safely and rapidly descending along a descent path external to the escaped structure.

The harness of the CDD is configured to be quickly and easily secured to a user's body (e.g., using a single fastener/connector assembly). A controlled cable release drum device (also referred to herein as drum device) secured to the harness is configured to controllably release a cable spooled thereinside over a cable reel at a controlled speed. In use, the user (also referred to herein as rescuee or evacuee) is harnessed to the CDD and secures the free end of the spooled cable to the high structure (specially prepared support, e.g., hook-like), and then exits the high structure (e.g., by jumping through a window, escape door, or from a building roof). As the user descends down from the high structure the spooled cable is controllably released from the drum device, thereby providing for safe descent of the rescuee to the ground.

The drum device is preferably attached to the back side of the harness to allow the user's front side to be free of bulky machinery, and thereby allow comfortable descent in a desired body position (e.g., upright, reclining, or inclined) while holding an object (e.g., a pet).

In a possible embodiment the harness has two torso straps (e.g., substantially vertical straps) connected by a suspension strap system configured as a suspension assembly defining a suspension point (a weight bearing point) at a predetermined location (e.g., corresponding to a lower back region of a harnessed user) and thereby guaranteeing a desired body position/posture of the harnessed user during the descent and facilitate in preventing suspension trauma to the descending user. Each torso strap generally comprises a back strap portion passing a long the rear side of the harness and extending at one end thereof into a shoulder strap portion designed to pass frontally and rest over/embrace a shoulder of the rescuee, and a waist strap portion designed to pass frontally and rest over/embrace the waist region of the rescuee.

The suspension strap system traverses (horizontally) the rear side of the harness and connects between the back strap portions of the torso straps, thereby forming a "Ж"-like shaped strap structure. The suspension strap system may comprise at least one back traverse strap passing horizontally and connecting between the back strap portions of the torso straps, and configured to provide the desired suspension point at a predetermined location thereon.

The suspension point/area may be located above the center of gravity of the harnessed user, and thus in some embodiments the suspension point/area is provided on the center/midpoint of the at least one back traverse strap, and/or at the area of the shoulder blades of the harnessed user. Optionally, and in some embodiments preferably, the at least one back traverse strap has a "^"-like shape and the suspension point is provided at the apex of the ^-like shaped strap structure.

The harness may further comprise a V-shaped crotch straps arrangement having an apex region and two arms extending therefrom, where said arms are connected to the waist portions of the torso straps. The V-shaped crotch straps arrangement is configured to pass frontally between the legs of the user and extend upwardly along the front side of the user's body (e.g., towards an abdomen region of the user's body). In some applications the two arms of the V-shaped crotch structure are connected to the shoulder strap portions of the torso straps to form two shoulder loops of the harness. In some variants, the apex portion of the V-shaped crotch strap arrangement is connected to the waist strap portions of the torso straps at the front side of the harness to form leg loops of the harness.

The connections between the torso straps and the free ends of the arms of the V-shaped strap arrangement may be applied at intersection (crossing) areas of the waist strap portions and the free ends of the arms. These intersection areas may be further utilized to define waist pieces of the harness, said waist pieces configured to extend frontally towards abdomen areas of the user's body and cover/embrace waist regions of the harnessed rescuee.

The waist pieces may be configured in the form of ear-like shaped structures each having an upper lobe and a lower lobe. In some embodiments the shoulder loops are formed by connection of the upper lobes of the waist pieces to the shoulder strap portions of the torso straps. The leg loops of the harness may be formed by connection of the lower lobes of the waist pieces to the apex region of the V-shaped strap arrangement.

In some embodiments the harness and the drum device attached to it are arranged to ensure an upright position/posture of the body of the rescuee during the fall and guarantee that orientation of the user's body is substantially vertical relative to the ground (i.e., with the head of the rescuee directed upwardly and legs of rescuee directed downwardly). Optionally, and in some embodiments preferably, the harness and the drum device attached to it are arranged to provide such vertical orientation of the rescuee's body while permitting a forward nose-down tilt of the rescuee body during the fall within some predefined angular range. Such nose-down tilt posture guarantees visibility of the descending path by the rescuee, thereby allowing the user to observe and skip possible obstacles therealong (e.g., by positioning the body and using the arms and legs to push away from the building) and prepare for "touch-down" before hitting the ground. Thus, such nose-down tilt posture assists in avoiding injury while descending, and possibly also in preventing suspension trauma.

In some embodiments the connection of the drum device to the harness is such that the drum device is situated at an upper portion of the back side of the harness (near, or over, the shoulder blades of the harnessed user) with a firm attachment (e.g., using fastening shackles and/or rings) to a suspension point located at a lower portion of the back side of the harness (i.e., around the lower back area of the harnessed user). Locating the suspension point at a lower back region of the harnessed rescuee provides that the orientation of the rescuee's body be substantially vertical to the ground during the fall while permitting the desired forward nose down tilt, and may further assist in preventing suspension trauma.

For example, and without being limiting, the upper side of the drum device may be attached to an upper portion of the suspension strap system, and its bottom side may be firmly attached to the suspension point located at a lower portion of the suspension strap system. Accordingly, in such implementations, the spooled cable may be released through an opening provided in an upper side of the drum device.

In some embodiments the drum device is mounted on the back side of the harness such that the rotation plane of the cable reel is substantially perpendicular to a plane in which the suspension strap system of the harness resides i.e., with the plane of rotation of the cable reel being substantially perpendicular to the frontal plane of the harnessed rescuee. In this configuration the drum device may be situated between, and protrude backwardly from between, the shoulder blades of the harnessed rescuee e.g., like a shark fin. The spooled cable may be released from the drum device through an opening located at the upper side of the drum device.

In some embodiments the drum device is arranged such that the rotations of the reel inside the drum device during the release of the cable along the fall causes a pitching moment (e.g., negative pitch moment, 'nose down moment') on the user's body and in effect causes the user's body to tilt forward such that user's face becomes slightly directed toward the direction of the fall (i.e., towards the ground).

Alternatively, and in some embodiments preferably, the drum device is attached to the harness such that the plane of rotation of the reel is substantially parallel to a plane in which the suspension strap system of the harness resides i.e., with the plane of rotation of the reel being substantially parallel to a frontal plane of the harnessed rescuee. The spooled cable may be released from the drum device through an opening provided in its upper side, and a bottom side of the drum device may be attached to the lower back side suspension point of the harness to facilitate a nose-down tilt of the user's body.

In some embodiments the drum device is mounted at a lower part of the back side of the harness (e.g., near the waist of the harnessed rescuee). For example, and without being limiting, a center point of the drum device may be attached at the lower back suspension point of the harness, to provide for a substantial vertical orientation of a rescuee's body during the fall, facilitate nose-down tilt, and assist in preventing suspension trauma.

In some embodiments, the CDD is configured to allow for the user to be in a reclining position with the user's head facing upwards while descending. Such a reclining position may be such that an imaginary line drawn from the user's shoulders to user's hips is at some predefined angle from a vector parallel to gravitational force (i.e., in the direction of the fall). For example, and without being limiting, the line drawn from the user's shoulder to the user's hip may be at an angle of about 30 to 60 degrees from a vector parallel to gravitational force.

In some embodiments the drum device is mounted at the back side of the harness and the released cable is passed through a sheath/conduit secured to the harness. In this configuration the released cable, and the sheath/conduit through which it passes, pass frontally between the legs of the user and extend therefrom upwardly along the front side of the user, to thereby allow the user to be in a reclining position with user's head directed upwardly while descending. The sheath may protect the cable while it feeds from the drum device during descent, to prevent the cable from causing friction burns to the user.

The conduit, which passes between a user's legs and guides the cable assists in positioning the user in a desired reclining position. Such a reclining position may be preferable in certain situations, such as when descending from a high building, to allow a user to position the body and use the arms and legs to push away from the building to avoid injury while descending and to possibly prevent suspension trauma.

In some embodiments the drum device is releasably maintained on the back side of the harness (e.g., in an upside-down state or in a pouch, or via another closure which may be easily released upon significant force such as gravitational forces pulling downwards on the user). For example, and without being limiting, in some embodiments the drum device is connected to the harness by straps and releasably held inside a pouch attached at the back of the harness (like a parachute). In use, the free end of the spooled cable is attached to a secure anchor in the high structure, and, as the user starts to descend therefrom, the drum device is pulled upwardly from the pouch to a position above the user's head, where it is maintained attached to the straps and controllably releases the spooled cable. The drum device may then release the spooled cable in a controlled manner, allowing for safe descent of the user. The positioning of the drum device above the head of the user during descent ensures that the user does not risk friction burn associated with a part of the user's body contacting the cable as it is being reeled out.

According to an embodiment of the invention, the CDD is configured to comprise a head-protecting element which is easily and quickly donned before descent to prevent the drum device from impacting the user's head when the user is using the CDD. The head protective element also offers helmet-like protection from falling objects and from other evacuees who may be descending in the vicinity of the user. In other embodiments the head-protecting element may be combined with a smoke mask or hood which may or may not have an integral air filter and protects the evacuee from heat and smoke inhalation.

Positioning of the drum device above the user's head during the fall allows for the user to descend in a substantially upright or a reclining position, and also frees the user's front side of bulky machinery, thereby allowing the user to comfortably descend in a sitting or standing position while holding an object (e.g., a pet) in front of the user.

In some embodiments the drum device comprises a centrifugal brake mechanism configured to control/restrict the rotation speed of the cable reel on which the cable is spooled.

In one aspect there is provided a harness for harnessing a user to a suspension device (e.g., a controlled descent device). The harness comprises a strap system having a plurality of straps configured and operable to connect the suspension device to a back region of the harness, each strap having a back end portion at the back region and connectable to the suspension device, and front end portion located in a front side of the harness, the straps extend from the back region to the front side and wrap around all sides of a torso of the user, and a single connector assembly configured and operable to permit quick connection of front end portions of at least some of the straps at the front side of the harness and thereby secure the harness to the user. The back end portions of the plurality of straps may be configured and operable to connect to a respective plurality of locations circumferentially distributed on a circumference of the suspension device.

The strap system may comprise an upper straps assembly comprising straps configured to wrap around upper and lateral sides of the user's torso, and a lower straps assembly comprising straps configured to wrap around the lower side of the user's torso, and wherein the lower assembly is connectable to the upper assembly by the quick connector assembly. The straps of the upper assembly may be connected to each other at the front side of the harness using either permanent or adjustable connecting means. The connection of the upper assembly straps forms two shoulder loops configured to receive the shoulders' of the user being harnessed.

Optionally, and in some embodiments preferably, the strap system comprises two or more intermediary straps for connecting between the lower straps assembly and the upper straps assembly. A back end portion of the intermediary straps may be connectable to the suspension device.

In some embodiments the upper straps assembly comprises two abdomen straps extending in opposite directions from lateral sides of the back region, the front end portion of each abdomen strap being connectable to a connecting element of the connector assembly, and two spaced apart shoulder straps, each extending from an upper side of the back region and being connectable to a respective abdomen strap by its front end portion, to thereby form a shoulder loop configured to receive a shoulder of the user. The lower straps assembly may comprise two spaced apart crotch straps extending from a bottom side of the back region, where the front ends of the crotch straps are connected to each other, thereby forming a V-shaped strap structure having an apex. Preferably, the apex of the V-shaped strap structure being connectable to a connecting element of the connector assembly.

In a possible embodiment the strap system comprises two spaced apart intermediary straps, where each intermediary strap extends from a bottom side of the back region of the harness and being connectable to a respective abdomen strap by its front end portion, and the back end portion of each crotch strap being connectable to a respective intermediary strap. Optionally, and in some embodiments preferably, each intermediary strap forms a V-shaped structure having an apex adapted for connection of the respective crotch strap.

In some applications a suspension plate is used for mounting the suspension device thereon. The suspension plate may comprise a plurality of locations circumferentially distributed on a circumference thereof and being connectable to the back end portions of the straps of the strap system. The suspension plate may comprise two side slots located at opposite lateral sides of the plate for connection of the back end portions of the abdomen straps thereto, two spaced apart top slots located in an upper region of the plate for connection of the back end portions of the shoulder straps thereto, and two spaced apart bottom slots located in a lower region of the plate for connection of the back end portions of the intermediary straps thereto.

The harness may comprise a bag adapted to enclose the suspension device thereinside. The bag of the harness comprises a bottom pocket usable for temporarily holding straps of the lower assembly of the harness before harnessing the user.

In some embodiments the strap system is configured and operable to cause a forward nose-down tilt of the user harnessed to the suspension device.

In another aspect there is provided a controlled descent device comprising a harness for wearing by a user. In a possible application the harness has front and rear sides and comprises a strap system having a plurality of straps configured and operable to connect the controlled descent device to a back region of the harness, each strap having a back end portion at the back region, for connecting to the controlled descent device, and a front end portion located at a front side of the harness, the straps extend from the back region to the front side of the harness and wrap around all sides of a torso of the user. A single connector assembly provided in the harness can be used for quick connection of front end portions of some of the straps at the front side of the harness and thereby secure the harness to the user.

Optionally, and in some embodiments preferably, the back end portions of the plurality of straps are configured and operable to connect to a respective plurality of locations circumferentially distributed on a circumference of the controlled descent device.

The strap system may comprise in some embodiments two abdomen straps extending in opposite directions from lateral sides of the back region, the front end portion of each abdomen strap being connectable to a connecting element of the connector assembly, two spaced apart shoulder straps, each extending from an upper side of the back region and being connectable to a respective abdomen strap by its front end portion, to thereby form a shoulder loop configured to receive a shoulder of the user, and two spaced apart crotch straps extending from a bottom side of the back region, the back ends of the crotch straps are connected to each other, thereby forming a V-shaped strap structure having an apex, where the apex being connectable to a connecting element of the connector assembly.

A suspension plate may be used for mounting the controlled descent device thereon. In possible applications the suspension plate being connectable to the back end portions of the straps of the strap system at a plurality of locations circumferentially distributed on a circumference thereof. For example, the suspension plate may comprise two side slots located at opposite lateral sides of the plate for connection of the back end portions of the abdomen straps thereto, two spaced apart top slots located in an upper region of the plate for connection of the back end portions of the shoulder straps thereto, and two spaced apart bottom slots located in a lower region of the plate for connection of the back end portions of the intermediary straps thereto. The controlled descent device may comprise a drum device secured to the suspension plate and configured and operable to control a rate of release of a cable spooled inside the drum device, to thereby provide a desired profile of the rate of descent.

In possible embodiments the drum device comprises: a housing and a cable reel rotatably mounted thereinside, the cable being spooled over the reel; an anchor fastener connected to a free end of the cable; and a brake mechanism inside the housing configured and operable to control the rate of release of the spooled cable.

In yet another aspect, the present invention is directed to a method of harnessing a user. The method comprises providing a harness having two spaced apart shoulder straps extending upwardly from a back region of the harness, two abdomen straps laterally extending in opposite directions from the back region of the harness, and a crotch strap assembly extending downwardly from the back region of the harness, introducing shoulders of the user into shoulder loops formed by connection of the two shoulder straps to two respective abdomen straps of the harness, passing the crotch straps assembly between legs of the user and wrapping it around a bottom side of the user's torso, and connecting the crotch straps assembly to the abdomen straps in a single operation by interlocking a connecting element associated with the crotch strap assembly to two connecting elements, each associated with one of the abdomen straps.

The harness may a bag located at the back region of the harness and having a bottom pocket suitable for holding the crotch strap assembly thereinside. The method may comprise releasing the crotch straps assembly from the bottom pocket before passing it between the user's legs.

The crotch strap assembly may comprise two spaced apart crotch straps extending downwardly from the back region of the harness.

The method may comprise connecting a suspension device to the harness by connecting back end portions of the shoulder, abdomen and crotch straps to a plurality of locations circumferentially distributed on a circumference of the suspension device.

Optionally, and in some embodiments preferably, the harness comprises two intermediary straps for connecting between a corresponding one of the crotch straps and at least one of the abdomen straps and shoulder straps. In some embodiments the connecting of the suspension device to the harness may comprise connecting back end portions of the intermediary straps to the suspension device. In some applications the connection between the suspension device and the crotch straps is provided via said intermediary straps.

BRIEF DESCRIPTION OF THE DRAWINGS

In order to understand the invention and to see how it may be carried out in practice, embodiments will now be described, by way of non-limiting example only, with reference to the accompanying drawings. Features shown in the drawings are meant to be illustrative of only some embodiments of the invention, unless otherwise implicitly indicated. In the drawings like reference numerals are used to indicate corresponding parts, and in which:

FIGS. 2A and 2B schematically illustrate a harness configuration according to some possible embodiments, wherein FIG. 2A is a simplified illustration of the harness, and FIG. 2B depicts a possible implementation thereof;

FIGS. 3A and 3B schematically illustrate harness and drum device arrangements according to possible embodiments wherein the drum device is attached at an upper portion of the back side of the harness, and wherein FIG. 3A depicts a CDD arrangement in which the drum device is substantially perpendicular to the back piece of the harness and FIG. 3B depicts a CDD arrangement in which the drum device is substantially parallel to the back piece of the harness;

FIG. 5B depicts the arrangement of the drum device and harness inside the backpack before changing the harness into its deployed state, and FIG. 5C depicts the drum and harness of the CDD in an unfolded state of the crotch support piece;

FIGS. 6A to 6D schematically illustrate a CDD configuration arranged as a backpack, wherein FIG. 6A depicts a front view of the CDD, FIG. 6B depicts a back view of the CDD, and FIGS. 6C and 6D depict a possible arrangement of the drum device;

FIGS. 7A to 7D schematically illustrate a harness arrangement according to some possible embodiments, wherein FIG. 7A shows a back view of the harness arrangement, FIG. 7B shows an exploded view of the harness arrangement, FIG. 7C is a back view illustrating the strap system of the harness, and FIG. 7D illustrates attachment of a suspension device to the strap system of the harness;

FIG. 10A to 10C schematically illustrate a CDD arrangement according to possible embodiments configured for a reclining descent position, wherein FIG. 10A depicts a back view, and FIGS. 10B and 10C, respectively depict perspective side and back views, of the CDD in use by a descending user; FIG. 11B depicts back views of the CDD respectively showing the crotch support of the CDD in a folded state and in a deployed state, and FIG. 11C depicts a front view of the CDD in use by the descending user.

DETAILED DESCRIPTION OF EMBODIMENTS

Figure 1:
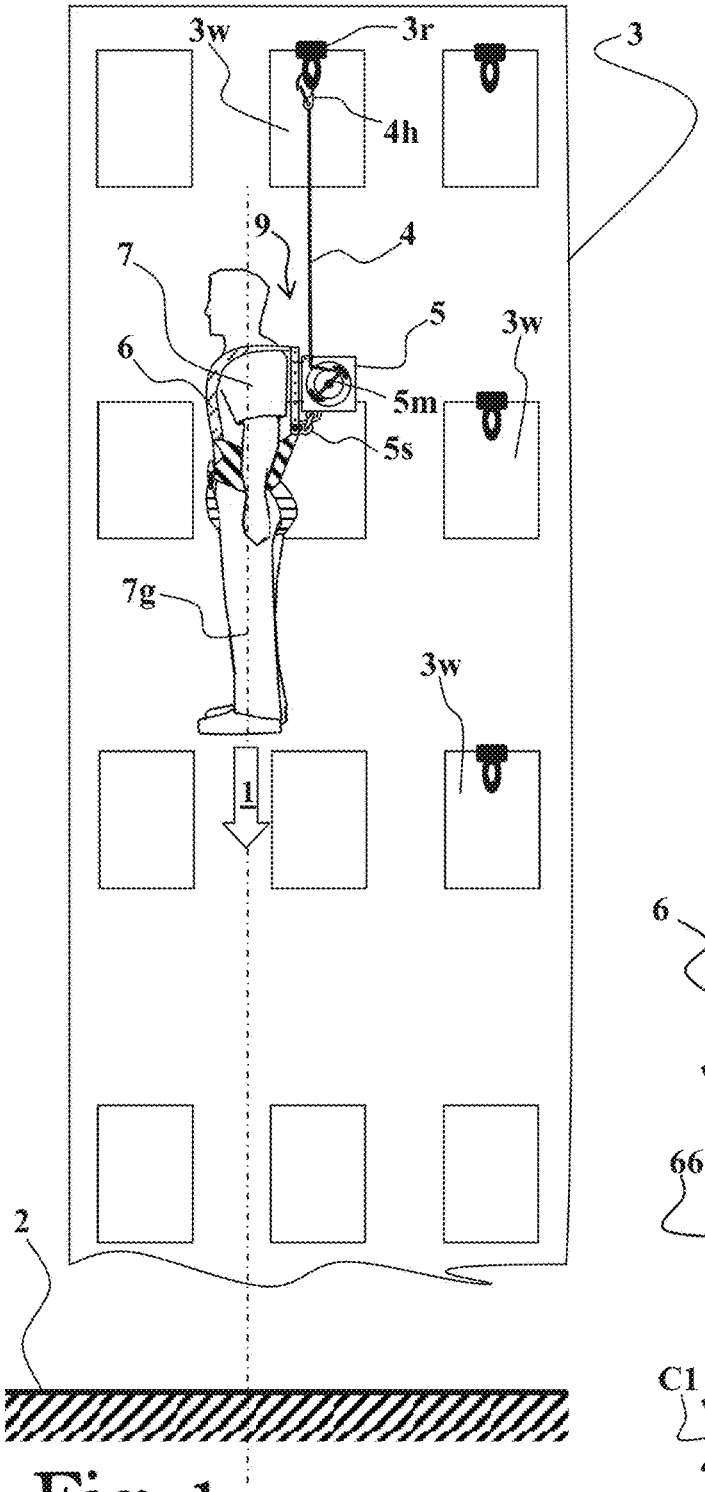
FIG. 1 exemplifies use of a CDD by a rescuee descending from a multi-storied building according to some possible embodiments.

The various embodiments of the present invention are described below with reference to the drawings, which are to be considered in all aspects as illustrative only and not restrictive in any manner. Elements illustrated in the drawings are not necessarily to scale, emphasis instead being placed upon clearly illustrating the principles of the invention. This invention may be provided in other specific forms and embodiments without departing from the essential characteristics described herein.

FIG. 1 exemplifies use of a CDD 9 according to some possible embodiments. In this non-limiting example, a rescuee 7 escaping a high structure 3 (e.g., building) safely descends from the structure by controlled release of a cable 4 spooled in the CDD 9. The CDD 9 comprises a harness 6 (e.g., type of adjustable quick fit harness) worn by the rescuee 7, and a drum device 5 attached to the back side of the harness 6, at the upper back area of the rescuee 7 (e.g., between the shoulder blades of the rescuee 7). The drum device 5 includes a spooled cable 4 having an anchor fastener 4*h* (e.g., a snap hook) attached to its free end and a brake mechanism 5*m* (e.g., centrifugal brake) configured to regulate the rate of cable release from the drum device 5 and thereby guarantee safe descent of the rescuee 7 to the ground 2.

As shown in FIG. 1, in order to escape the structure 3 (e.g., in an emergency situation, such as a spreading fire) the rescuee 7 wears the harness 6, secures the anchor fastener 4*h* to an anchor member 3*r*, preferably an anchor fixture fixedly attached to the structure 3 (e.g., anchor ring), and exits the structure 3 e.g., through an opening 3*w* such as a window, exit/escape door, or the like. After exiting the structure 3 the rescuee 7 is pulled downwards by gravity (shown by arrow 1) towards the ground 2 and the spooled cable 4 is progressively released from the drum device 5 as the rescuee 7 descends downwardly towards the ground 2. In this non-limiting example the harness 6 and drum device 5 arrangement guarantees that orientation of the body of the rescuee 7 during the fall is substantially vertical relative to the ground 2. The brake mechanism 5*m* provided in the drum device 5 is configured to controllably release the spooled cable 4 within predefined release rates and thereby maintain a substantially controlled descent speed (e.g., about 1 to 2 msec) of the rescuee 7, until safely reaching the ground 2.

Figure 2A:
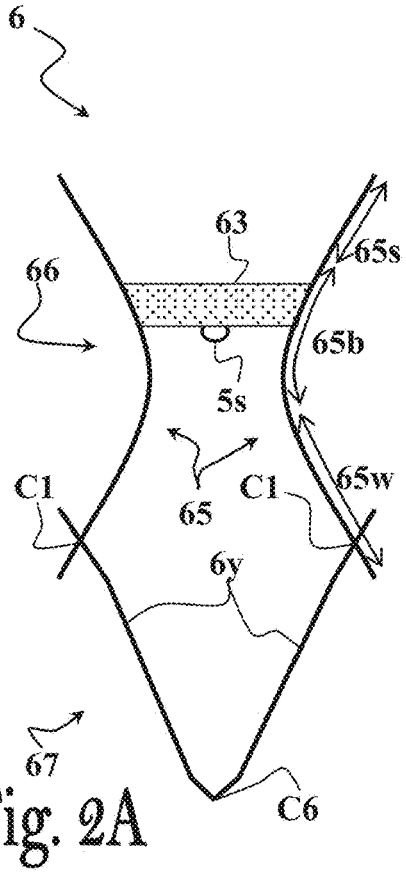
Figure 2B:
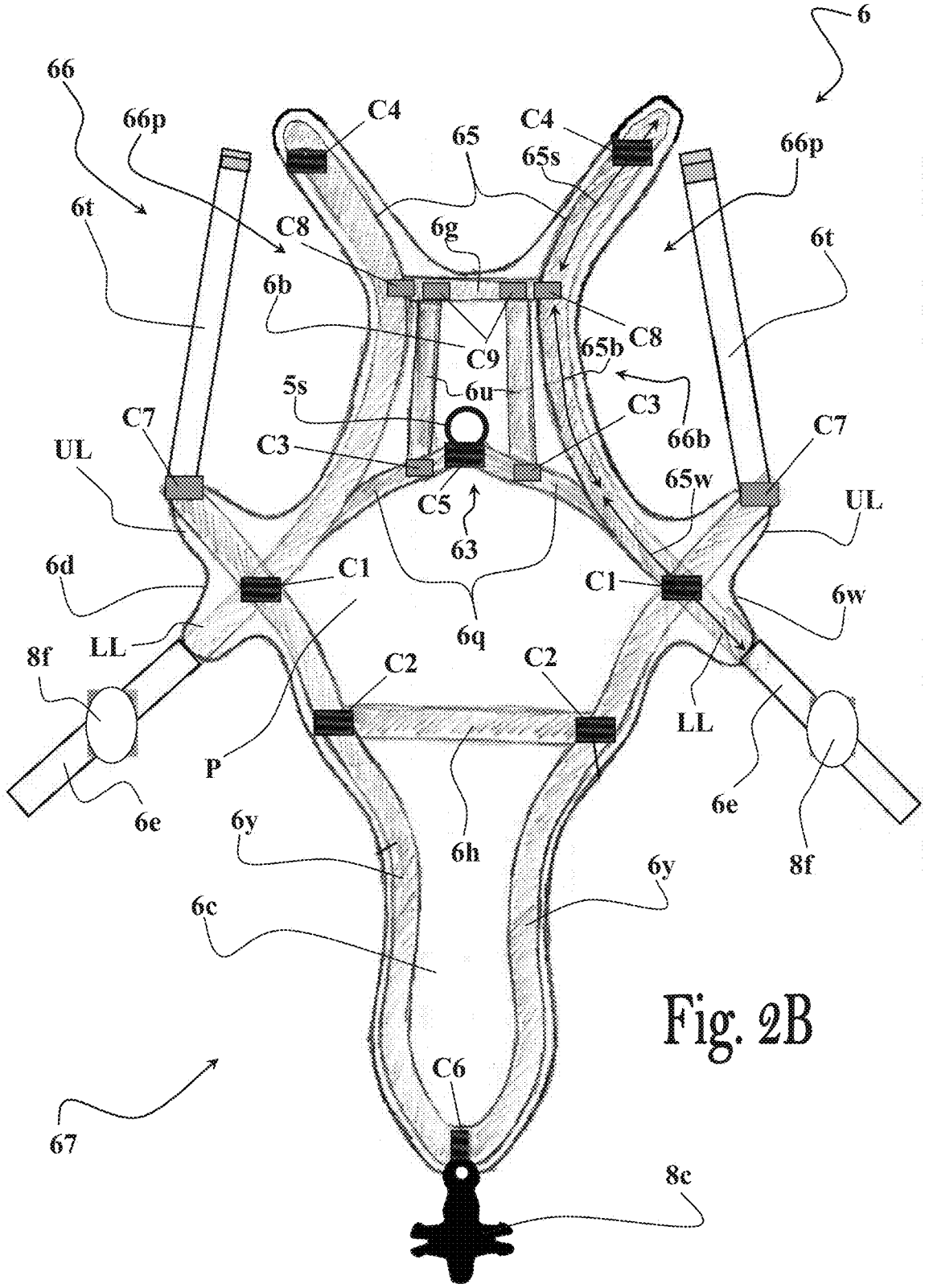

FIGS. 2A and 2B show a harness design according to some possible embodiments. With reference to FIG. 2A, in some embodiments the harness 6 includes an upper strap arrangement 66 comprising two substantially vertical torso straps 65 and a suspension strap system 63 traversing the back side of the harness (i.e., passing horizontally) and connecting between the torso straps 65, thereby forming a "Ж"-shaped upper strap structure 66. The suspension strap system 63 may comprise at least one back traverse strap (6*q* in FIG. 2B) connecting between the torso straps 65 (e.g., the back strap portions 65*b*) and being configured and operable as a suspension assembly defining a suspension point at a predetermined location (at 5*s*) corresponding to a lower back region of the user.

An attachment member 5*s* secured at a lower region of the suspension strap system 63 may be used to provide a suspension point located at a lower back area of the harnessed user 7. With this configuration of the harness 6 the drum device 5 is attached to the suspension point 5*s* located at the lower back area of the harnessed rescuee which facilitates positioning the body of the harnessed rescuee in a desired upright substantially vertical body posture during the fall. As will be explained hereinbelow, this configuration of the harness 6 may be further employed to evenly distribute the tensions exerted over the different straps of the harness 6, and thereby assist in preventing suspension trauma.

Each torso strap 65 includes a back strap portion 65*b* passing along the back side of the harness 6, a shoulder strap portion 65*s* extending upwardly from one end of the back strap portion 65*b*, and a waist strap portion 65*w* extending downwardly from another end of the back strap portion 65*b*. More particularly, the shoulder strap portions 65*s* of the torso straps 65 are designed to pass frontally over the shoulders of the user 7, and therefrom downwardly along the front side of the user, and the waist strap portions 65*w* are designed to pass frontally over waist regions of the user 7 towards abdomen 30 areas of the user. The extremities of the torso straps 65 may be connectable to each other by a connecting means (not shown), and/or by chest straps (6*t* in FIG. 3B), to thereby form two shoulder loops (66*p* in FIG. 3) designed for fitting the harness straps over the shoulders of the user.

The harness 6 may further comprise a bottom strap arrangement 67 having a V-shaped structure connected to the waist strap portions 65*w* of the torso straps 65. For example, and without being limiting, the connection between the torso straps 65 and the V-shaped strap structure 67 may be applied at intersection points C1 wherein the upper portions of the arms 6*y* of the V-shaped strap structure 67 and the waist strap portions of the torso straps 65 are crossed. As will be described hereinbelow, the apex region C6 of the V-shaped strap structure 67 is connectable to the extremities of the arms of the V-shaped strap structure 67 (e.g., by belly straps 6*e* shown in FIG. 3B) to thereby form leg loops (66*g* in FIG. 3) of the harness.

Referring now to FIG. 2B, showing a possible implementation of the harness design exemplified in FIG. 2A comprising the upper strap arrangement (66) and the bottom strap arrangement (67). In this non-limiting example the back strap portions 65*b* extend vertically along the sides of a back piece 6*b* of the harness 6, which includes the suspension strap system 63. As seen, the suspension strap system 63 includes two spaced apart back traverse straps; the back traverse strap 6*q* having a "^"-shaped structure passing (horizontally) along the bottom side of the back piece 6*b* and connected to the torso straps 65 at points C1, and an upper back traverse strap 6*g* passing (horizontally) along the upper part of the back piece 6*b* (at shoulder area of the rescuee 7) and connected at points C8 to the torso straps 65. The suspension strap system 63 may also comprise two or more spaced apart vertical shoulder-blade support straps 6*u* passing vertically along the back piece 6*b* and connected to the upper back traverse strap 6*g* at their upper ends (at points C9) and to the lower back traverse strap 6*q* at their lower ends (at points C3).

Figure 3A:
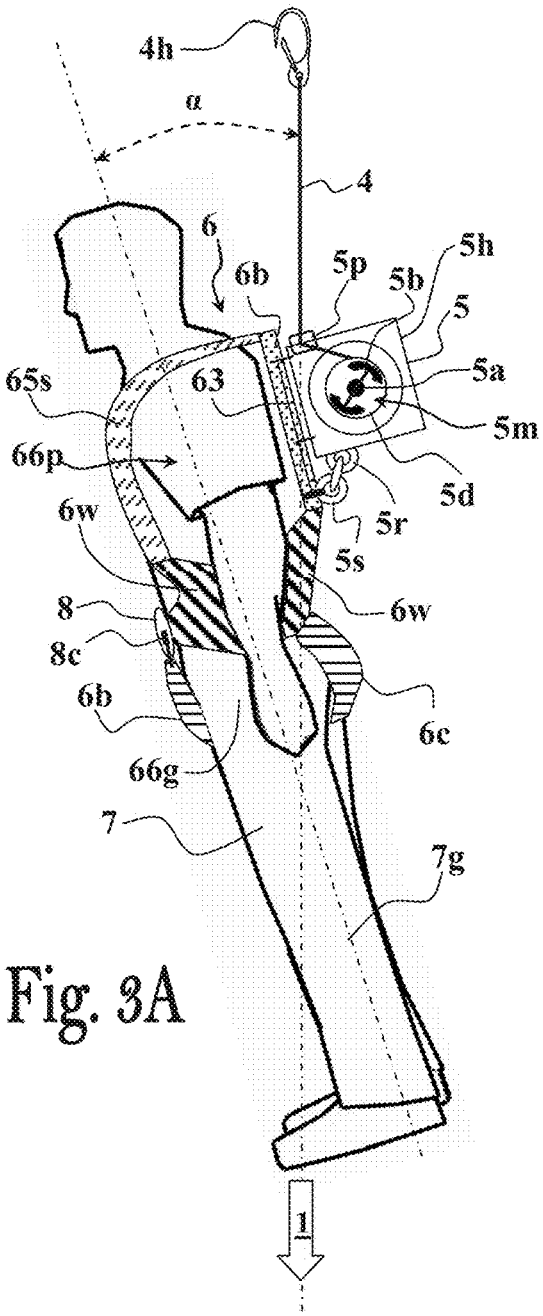
Figure 3B:
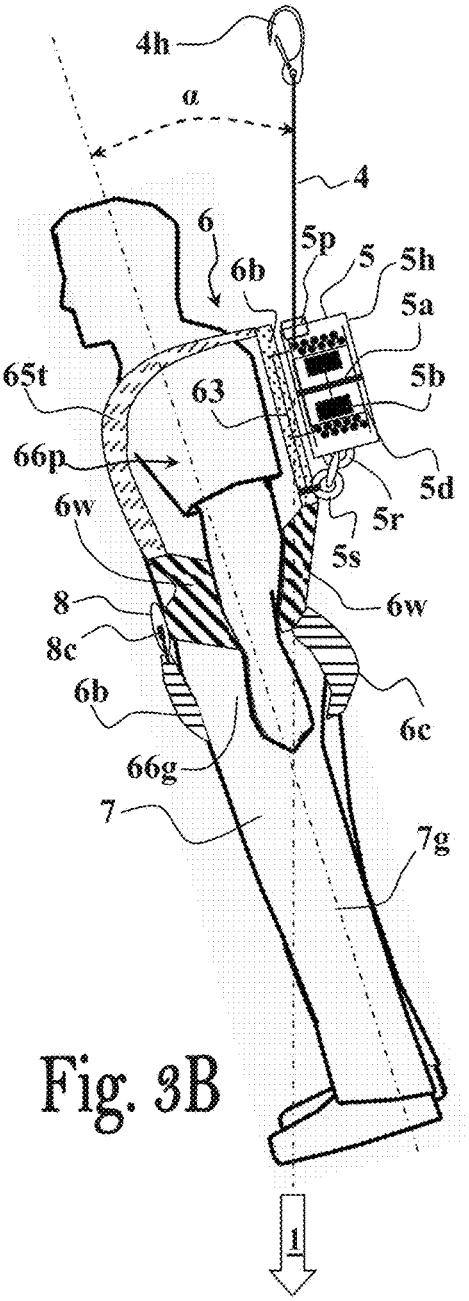

As also seen in FIG. 3B, the bottom strap arrangement 67 is generally a V-shaped strap structure having two straps 6*y* (also referred to herein as arms) tapering downwardly towards the apex region of the structure situated at the free end (at 8*c*) of the crotch piece 6*c*. The intersections of the waist strap portions 65*w* of the torso straps 65 and the upper arm portions of the V-like shaped strap structure 6*y* form/define two waist pieces 6*w* of the harness 6 designed to pass frontally along the waist of the harnessed user towards abdomen areas of the user. The V-shaped strap structure 6*y* is part of the crotch piece 6*c* designed to pass between the legs of the rescuee 7, and its arms extend downwardly from the waist (and back) pieces 6*w* and pass along the sides of the crotch piece 6*c*. In some embodiments the V-shaped strap structure 6*y* further includes a buttock strap 6*h* passing horizontally between the 'arms' of the V-shaped strap 6*y* for supporting the bottom of the harnessed rescuee 7.

As exemplified in FIG. 2B the torso straps 65 may extend upwardly from a lower lobe LL of the waist pieces 6*w*, passing vertically along the sides of the back piece 6*b* and therefrom over the shoulders of the rescuee 7 towards the rescuee's front side and downwardly towards the chest of the rescuee. The V-shaped straps 6*y* may extend from an upper lobe UL of the waist pieces 6*w* downwardly towards the rescuee's buttock (at buttock strap 6*h*), and therefrom upwardly along the front side of the rescuee 7 towards the abdomen area of the user. In this configuration the torso straps 65 extending upwardly from a lower lobe LL of the waist pieces 6*w* and the V-shaped straps 6*y* extending downwardly from an upper lobe UL of the waist pieces 6*w* are crossed at the waist area of the rescuee (at points C1 in the waist pieces 6*w*).

As described above, the front ends of the waist pieces 6*w* may be shaped to form ear-like structures having upper lobes UL and lower lobes LL. The upper lobes UL of the waist pieces 6*w* are connectable to the free ends of the shoulder strap portions 65*s* by chest straps 6*t* (at points C4 and C7). In some embodiments connection of the chest straps 6*t* to the shoulder strap portions 65*s* is implemented using a type of adjustable connection mechanism (e.g., buckles). Two belly straps 6*e* may be connected to the lower lobes LL of the waist pieces 6*w*. Alternatively, the belly straps 6*e* may be implemented as an integral part of the shoulder strap portions 65*s*, which may thus extend beyond the waist pieces 6*w* towards the abdomen area of the rescuee (7). As also seen in FIG. 2B, the belly straps 6*e* include connection elements 8*f* (e.g., adjustable slide buckles) configured to implement quick connection of the waist pieces 6*w* to the free end (at 8*c*) of the crotch piece 6*c*.

FIG. 2B demonstrates various strap connection points, as follows: at the crossing area C1 of the V-shaped straps 6*y* and shoulder strap portions 65*s;* at the apex portion of the V-shaped strap structure 6*y* for connecting a quick connection element 8*c* (e.g., "T"-lock bar/male part of quick-lock buckle) at C6; at the midpoint C5 of the lower back traverse strap 6*q* for connecting the arms of its A-shaped structure to each other, and for connecting the attachment member 5*s* thereto; and at the extremities C2 of the buttock strap 6*h* for connecting it to the V-shaped strap structure 6*y*. In some embodiments, the connection point C1, of the free ends of the V-shaped straps 6*y* and of the free ends of the waist strap portions of the torso straps, may be further used to connect the extremities of the back traverse strap 6*q* at the waist pieces 6*w* areas of the harness.

The connection of the various straps and their connection points may be carried out by stitching, welding, using rivets/bolts, buckles and/or adhesives, or any combination thereof. The harness 6 may further comprise one or more mesh and/or padding layers 6*d* applied over the straps.

Referring now to FIGS. 3A and 3B, as seen, different arrangements of the harness 6 and drum device 5 of the CDD 9 may be used. For example, and without being limiting, in FIG. 3A the drum device 5 includes a cable reel 5*d* and it is attached to the suspension strap system 63 provided in the back piece (or plate) 6*b* of the harness 6 such that the plane of rotation of the cable reel 5*d*, rotatably mounted inside the drum device 5, is substantially perpendicular to the back piece 6*b* (i.e., perpendicular to a frontal plane of the harnessed user) and is aligned with a longitudinal axis 7*g* thereof (i.e., in, or in parallel to, a sagittal/median plane of a rescuee's body). In another non-limiting example, depicted in FIG. 3B, the drum device 5 is attached to the suspension strap system 63 of the harness 6 such that the plane of rotation of the cable reel 5*d* is substantially parallel to the back piece 6*b* (i.e., parallel to a frontal plane of the harnessed rescuee 7).

As exemplified in FIGS. 3A and 3B, in these non-limiting examples the harness 6 and drum device 5 may be arranged such that the orientation of the body of the rescuee 7 during the fall is forwardly inclined, relative to the descent direction 1, with the head of the rescuee 7 directed upwardly, as exemplified in FIG. 1.

FIGS. 3A and 3B further show the shoulder strap portions 65*s* extending frontally from the sides of the upper part of the back piece 6*b* over the shoulders of the rescuee 7 and then passing downwardly along the front side of the rescuee's body are connected to the two waist pieces (or straps) 6*w* extending frontally form the lower part of the back piece 6*b* towards the front side of the rescuee 7. Particularly, in this non-limiting example, upper sides of the free ends of the waist pieces 6*w* are connected to (or integral part of) the free ends of the shoulder strap portions 65*s* to thereby form two shoulder loops 66*p*, that are wearable by passing the rescuee's arms through the shoulder loops 66*p*, and placing the shoulder strap portions 65*s* over the shoulders of the rescuee 7.

FIGS. 3A and 3B further show the crotch piece (or straps) 6*c* extending from the lower side of the back piece 6*b* and passing between the legs of the rescuee 7 and then passing upwardly along the front side of the rescuee 7. The harness 6 further comprises, in this non-limiting example, a quick connector mechanism 8 (e.g., safe-T-bar buckle) configured to enable quick connection (and release) of the waist pieces/straps 6*w* to the free end (at 8*c*) of the crotch piece/strap 6*c* at a location over the rescuee's abdomen.

As shown in FIGS. 3A and 3B the drum device 5 may comprise a housing 5*h* in which the cable reel 5*d* is operably mounted for rotation about a rotation axis 5*a*. The cable 4 is spooled on the cable reel 5*d* and its free end (to which the anchor fastener 4*h* is attached) exits the housing 5*h* through an opening 5*p* provided at the top side of the housing of the drum device 5. In some embodiments a centrifugal brake mechanism is mounted inside the cable reel 5*d* configured to rotate movable brake elements 5*b* (e.g., brake shoes) thereinside in a direction opposite to the direction of rotation of the cable reel 5*d* (e.g., using a planetary gear—not shown). In this way, while the spooled cable 4 is gradually released through the opening 5*p* during the fall, the cable reel 5*d* rotates inside the housing 5*h* and the brake elements 5*b* rotating in a counter direction become pressed against the inner wall of the cable reel 5*d* due to centrifugal forces acting on them. Friction forces evolving between the movable brake elements 5*b* and the inner wall of the cable reel 5*d* slow the rotation speed of the cable reel 5*d* and thus adjust the descent speed of the rescuee 7 towards the ground 2.

Possible embodiments of the centrifugal brake mechanism are described in Israeli Patent Application No.235049, titled "Centrifugal Brake", of the same applicant hereof. It should be however understood that the present invention is not limited to a specific centrifugal brake mechanism, and that other suitable brake mechanisms may be used in possible embodiments of the invention.

Optionally, and in some embodiments preferably, the harness 6 and drum device are arranged such that an inclination of a rescuee's body relative to the direction of the fall 1 is caused during the fall, as demonstrated in FIGS. 3A and 3B. In this non-limiting example, the desired body inclination is achieved by arranging the CDD such that the drum device 5 is attached to the harness 6 (e.g., by "O"-rings and/or shackles 5*r*) at a suspension point (e.g., at 5*s*) located at a lower portion of the back piece 6*b* of the harness 6 (e.g., about, or slightly above the center of gravity of the rescuee). In this way, by lowering the suspension point of the rescuee 7 towards the lower back area, a forward tilt ("nose-down tilt" of$\alpha$ degrees e.g., about 5° to 10°) of the rescuee's body is enabled during the fall. Such nose-down tilt advantageously provides the rescuee a downward line of sight, thereby allowing the rescuee 7 to observe and skip possible obstacles along the fall path 1, see the approaching ground 2, and prepare to hit it.

For this purpose, the harness 6 may be provided with an attachment member 5*s* (e.g., anchor ring or eye) of the suspension strap system 63 fixedly secured at the lower part of the back piece 6*b* and above the crotch piece 6*c*. The CDD configuration demonstrated in FIG. 3A may be further adjusted to facilitate the desired nose-down tilt by configuring the rotating drum 5*d* to apply a pitching moment (e.g., a negative pitching moment) on the body of the rescuee 7.

Figure 4A:
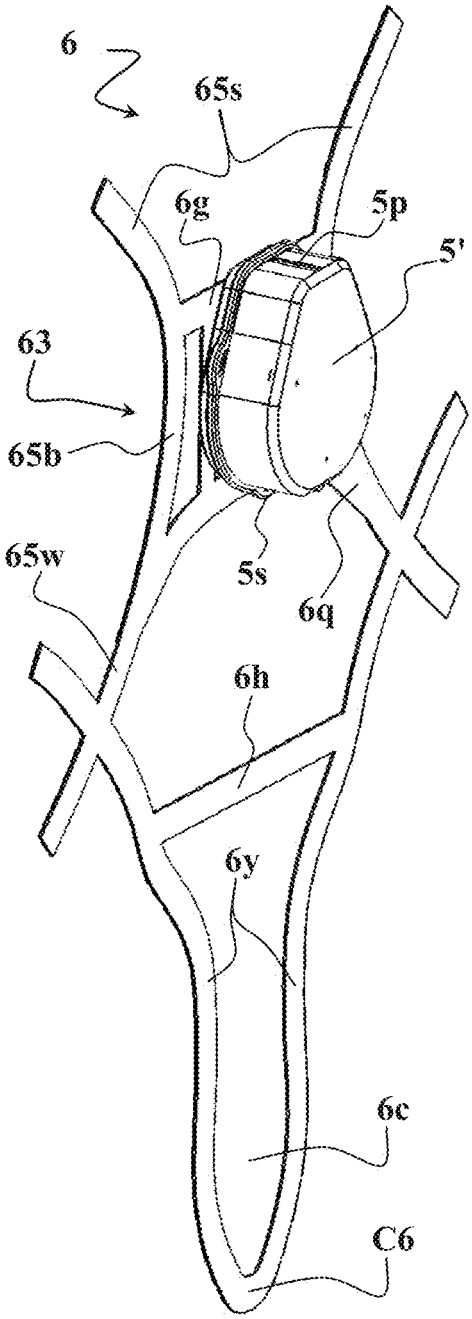
FIGS. 4A and 4B schematically illustrate a CDD and harness arrangement according to possible embodiments shown in perspective back and front views, respectively.
Figure 4B:
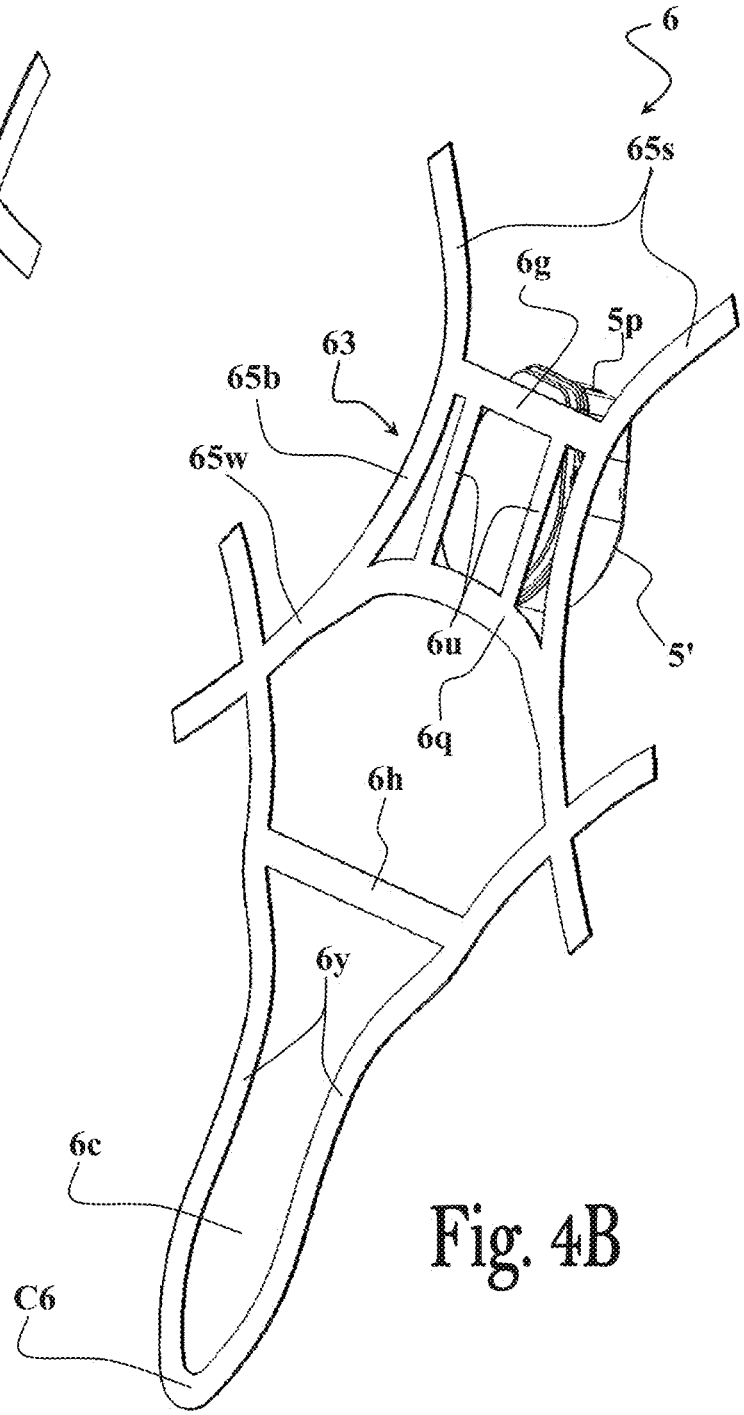

FIGS. 4A and 4B exemplify connection of the drum device 5' to the harness 6. In this non-limiting example the drum device 5' is substantially parallel to the suspension strap system 63 of the back piece (6*b*). The upper side of the drum device 5' includes an opening 5*p* through which the spooled cable is released, and the bottom side of the drum device is attached to the center of the lower back traverse strap 6*q* to form a lower suspension point (at 5*s*) for allowing tilting the body of the rescuee 7 forwardly. The drum device 5 may be also connected to the upper back traverse strap 6*g* and/or to the shoulder-blade support straps 6*u*, however, this additional connection may be a loose or elastic connection suitable for mounting the drum over an upper area of the back piece (6*b*) while guaranteeing the desired lower suspension point at 5*s*.

Figure 5A:
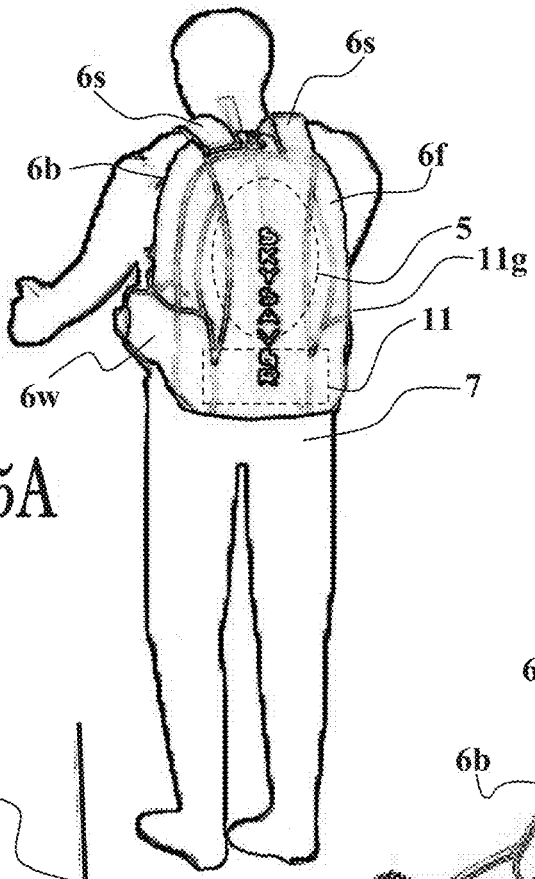
FIGS. 5A to 5C schematically illustrate a CDD configuration according to some possible embodiments wherein a crotch support piece of the harness is held releasable undeployed inside a compartment of the CDD in its unused state, wherein FIG. 5A demonstrates an embodiment wherein the CDD is configured in the form of a backpack/bag.
Figure 5B:
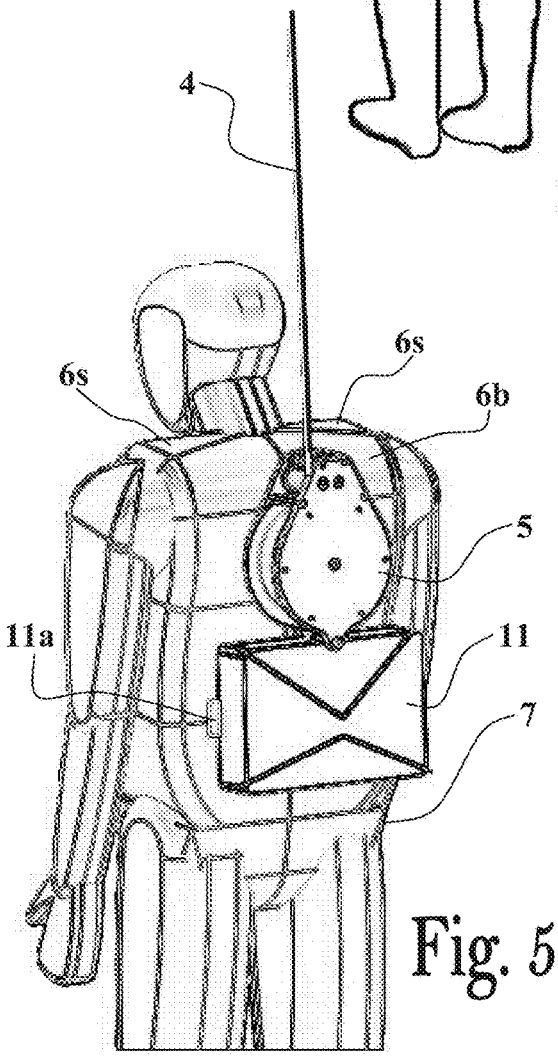
Figure 5C:
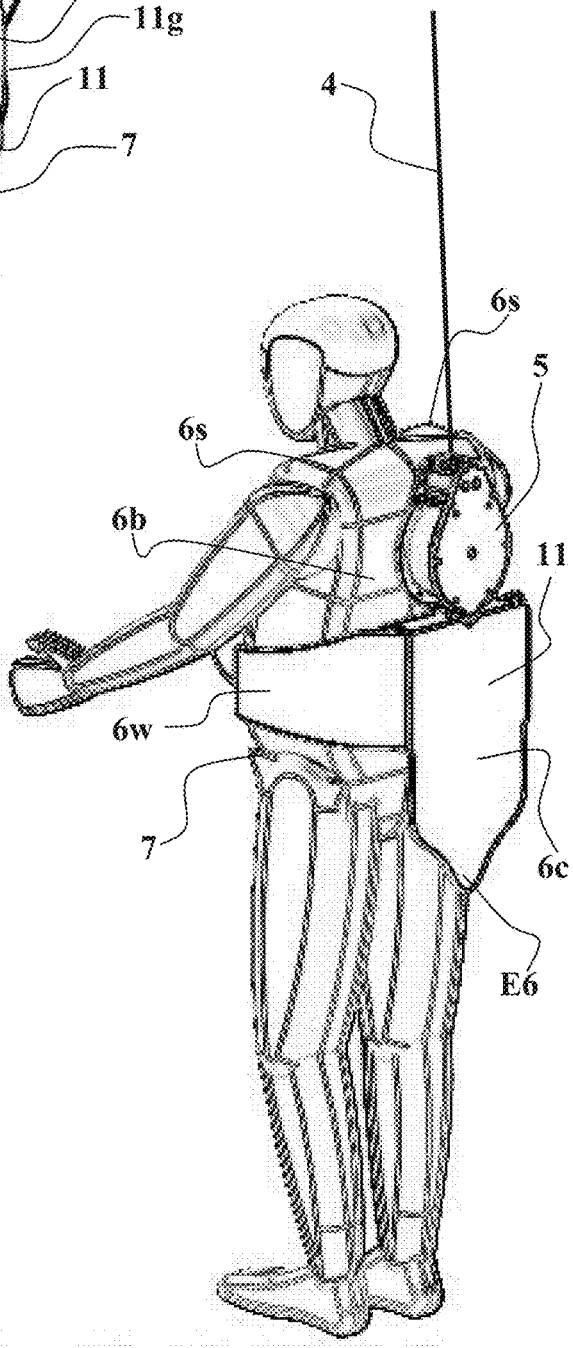

FIGS. 5A to 5C demonstrate possible embodiments wherein the CDD is implemented in the form of a backpack 11*g*. With reference to FIG. 5A, the backpack 11*g* is configured to comfortably enclose and carry the drum device 5 and a releasable crotch piece assembly 11. In this non-limiting example, the CDD comprises waist pieces 6*w* extending frontally from the back piece 6*b* of the backpack 11*g*, and a cover 6*f* enclosing the drum device 5 and the releasable crotch piece assembly 11 inside the backpack 11*g*.

FIG. 5B shows the CCD without the cover 6*f* and with the crotch piece assembly 11 in a folded state. The crotch piece assembly 11 may comprise a quick release handle 11*a*, usable for quickly changing the folded crotch piece 11 into its open state, as exemplified in FIG. 5C. The quick release handle 11*a* may be situated in any suitable location in the CDD allowing easy and convenient access to it by the user. In use, the user 7 pulls the quick release handle 11*a* to release the crotch piece 11 by changing its state into an unfolded state, and then draws the unfolded crotch piece 11 between the user's legs and secures the apex region E6 to the waist pieces 6*w* over an abdomen region thereof.

Figure 6B:
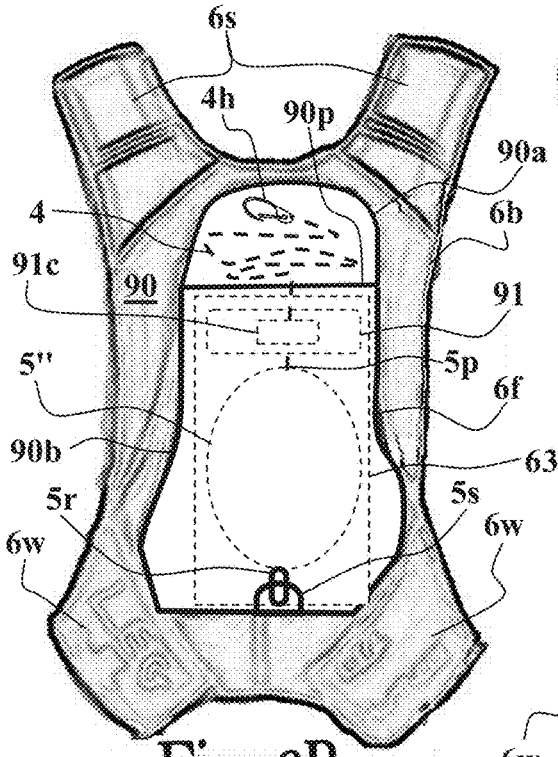
Figure 6A:
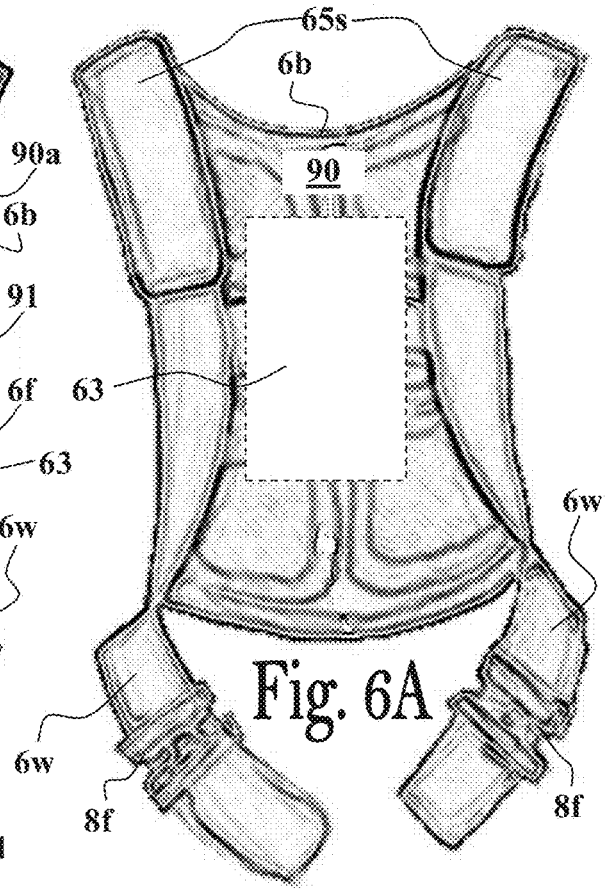

FIGS. 6A to 6D schematically illustrate a CDD arrangement configured in the form of a backpack. FIG. 6A shows a front view of the CDD 90, according to a possible embodiment, comprising a back piece 6*b*, two spaced apart shoulder straps 65*s* extending frontally from the upper side of the back piece 6*b*, and two waist straps 6*w* extending frontally from lateral sides and the bottom side of the back piece 6*b*. As seen, the waist straps 6*w* include connection elements 8*f* configured to permit quick connection of the waist straps 6*w* over an abdomen region of the harnessed user. The back piece 6*b* may comprise a suspension strap system 63 as described hereinabove with reference to FIGS. 2A and 2B.

Referring now to FIG. 6B showing a back view of the CDD 90. As seen, the back piece 6*b* includes a backpack cover 6*f* enclosing the drum device 5" and a portion of unspooled cable 4 including the anchor fastener 4*h* secured to the free end of the cable. In this non-limiting example the CDD 90 further includes a cable guiding unit 91 situated within the backpack arrangement of the CDD above the drum device 5". A first compartment 90*a* of the backpack arrangement 90, located at an upper part of the back piece 6*b*, may be used for accommodating a predetermined length of unspooled cable 4 thereinside together with the anchor fastener 4*h* secured thereto, and another compartment 90*b* of the backpack arrangement 90, located at a lower part of the back piece 6*b*, may be used for accommodating the drum device 5" and the cable guiding unit 91.

Figure 6D:
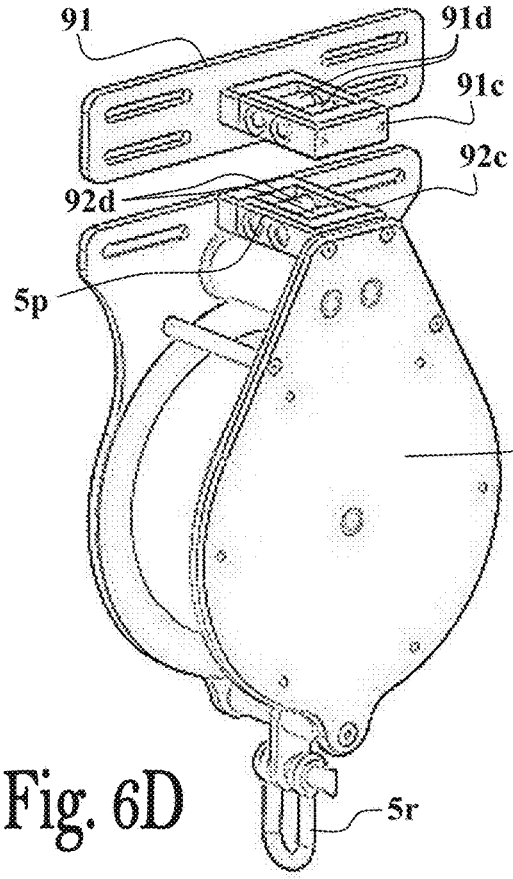
Figure 6C:
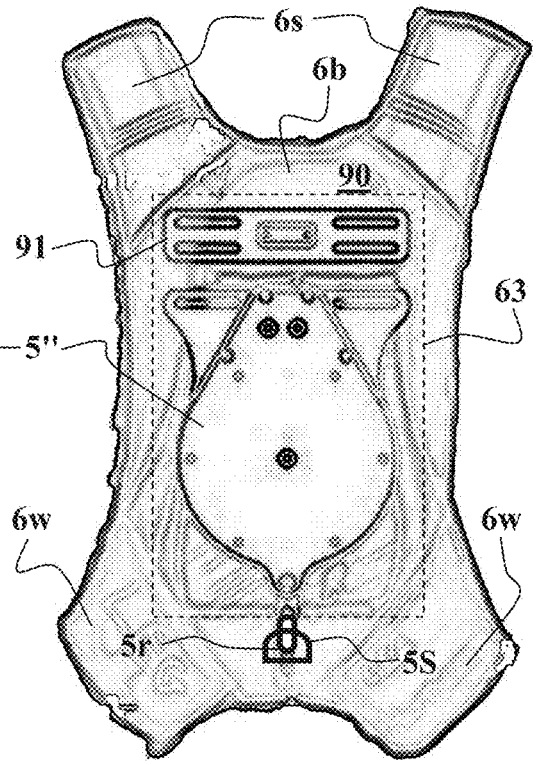

In this configuration the unspooled portion of the cable extending from the cable release opening 5*p* is engaged in the cable guiding unit 91 located above the drum unit 5", and passes therefrom through a partition 90*p*, separating between the compartments 90*a* and 90*b*, into the upper compartment 90*a*. As shown in FIGS. 6B and 6C, the drum device 5" may be secured (e.g., by "O"-rings and/or shackles 5*r*) to the suspension strap system 63 at a suspension point at 5*s* located at a lower portion of the back piece 6*b*. Referring now to FIG. 6D, the cable release opening 5*p* of the drum device 5" may include a cable guiding assembly 92*c* (e.g., using rollers 92*d*) configured to smoothly guide the cable released from the drum device 5" during descent. The cable guiding assembly 92*c* may be further configured to ensure one way outside passage of the cable 4 through the opening 5*p* and prevent undesired return of the cable therethrough into the drum device 5" (e.g., by using a ratchet mechanism—not shown).

Similarly, the cable guiding unit 91 located above the drum device 5" may also include a cable guiding assembly 91*c* (e.g., using rollers 91*d*) for smoothly releasing the cable from the CDD, which may be also configured to ensure one direction cable passage therethrough. In some embodiments employing rollers 91*d* and 92*d* in the cable guiding assemblies 91*c* and 92*c* respectively, the rollers 91*d* and 92*d* may be arranged such that one set of rollers is substantially perpendicular to the other, thereby guaranteeing that the cable is released from the drum substantially straight upwardly without entangling with the straps and/or other parts of the harness.

Figure 7A:
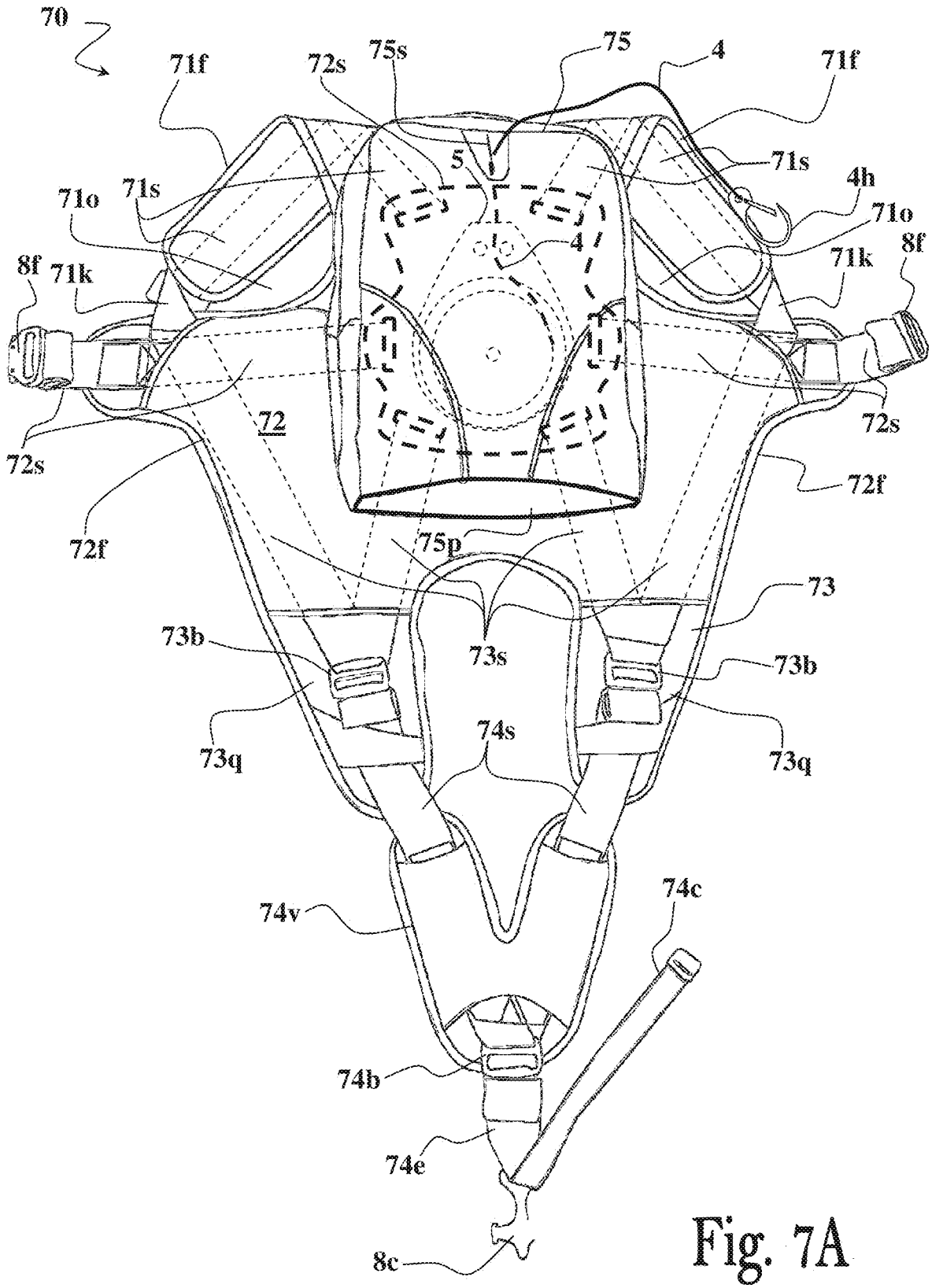

FIGS. 7A to 7D schematically illustrate a harness 70 having a single strap connector arrangement. With reference to FIG. 7A, the harness 70 may comprise a back-piece or a backpack (hereinafter referred to as backpack 75), to which a suspension device 5 can be attached. Two spaced-apart shoulder straps 71*s* of the harness 70 extend from an upper portion of the backpack 75, and two abdomen straps 72*s* extend laterally (sideways) from the opposite sides of the backpack 75. Two spaced-apart crotch straps 74*s* define a bottom portion of the harness 70 and are designed to pass between the user's legs and along the front side of the user. Two intermediary straps 73*s* extend downwardly from a bottom side of the backpack 75 and define apexes 73*b* at a lower back area of the harness 70, wherefrom the intermediary straps extend upwardly and their ends are connected (e.g., by stitches 73*t* shown in FIG. 7C) to the abdomen straps 72*s*.

In other words, the intermediary straps 73*s* are arranged to form two spaced apart V-shaped structures connecting the abdomen straps 72*s* of the harness 70 to the crotch straps 74*s* attached to their apexes (at 73*b*). Particularly, each intermediary strap 73*s* connects, by one arm of its V-shaped structure, one crotch strap 74*s* to a respective abdomen strap 72*s* of the harness 70, and by the other arm of its V-shaped structure, connects the crotch strap 74*s* to the backpack 75. This configuration of the intermediary straps 73*s* facilitates even distribution of the load of the harnessed user over the different straps of the harness 70, and enables quick connection of the shoulder (71*s*) and abdomen (72*s*) straps to the V-shaped crotch straps 74*s* by a single connector assembly (e.g., using a "T"-lock buckle).

The shoulder straps 71*s* extend from an upper portion of the backpack 75 and pass downwardly along the frontal side of the harness 70 where the free end (at 71*b* in FIGS. 7B and 7C) of each shoulder strap 71*s* is connected to a respective loop adjustment strap 71*k* of the harness 70. Each loop adjustment strap 71*k* is connected at one end to a respective abdomen strap 72*s* (e.g., by stitches 73*t*) and at its free end connects to the respective shoulder strap 71*s* (e.g., by slide buckles 71*b*), thereby forming two adjustable shoulder loops 71*o* of the harness 70. The crotch straps 74*s* are connected to the apexes (e.g., by slide buckles 73*b*) of the V-shaped intermediary straps 73*s* and extend downwardly forming a V-shape structure having an apex (at 74*b*) where their free ends are connected to each other.

A quick connector 8*c* (e.g., "T"-lock bar) connected (e.g., via slide buckle 74*b*) by an adjustable strap 74*e* to the apex of the crotch straps 74*s*, and two connecting elements 8*f* (e.g., female part of quick lock buckle) provided at the free ends of the abdomen straps 72*s*, are used for harnessing the user by passing the V-shaped crotch straps 74*s* between the user's legs and therefrom upwardly along the front side of the user, and connecting the quick connector 8*c* to the connecting elements 8*f* at the abdomen (or lower chest) area of the user. The backpack includes a bottom pocket 75*p* having an underside opening at the bottom side of the backpack 75 for holding the V-shaped crotch straps 74*s* of the harness 70 in a folded state, and allowing quick release of the crotch straps 74*s* therefrom for harnessing to the user.

A suspension device 5 (e.g., parachute or drum device) can be connected to the to end portions (71*s*', 72*s*' and 73*s*' in FIG. 7B) of the shoulder, intermediary and abdomen, straps of the harness 70 residing inside the backpack 75, thereby defining a back suspension area of the harness 70 configured and operable to equally distribute the load of the harnessed user between the different straps wrapping the user's torso, and thereby facilitate in preventing suspension trauma. A cable slit 75*s* provided in an upper region of the backpack 75 can be used for releasing a cable 4 of the suspension device 5 attached to the harness 70 inside the backpack 75, to the outside of the backpack 75. In this non-limiting example the suspension device 5 comprises a drum device configured and operable to controllably release the cable 4 having an anchor fastener 4*h* attached to its free end. The anchor fastener 4*h* may be releasably attached to one of the shoulder straps 71*s* near the chest area of the user.

Figure 7B:
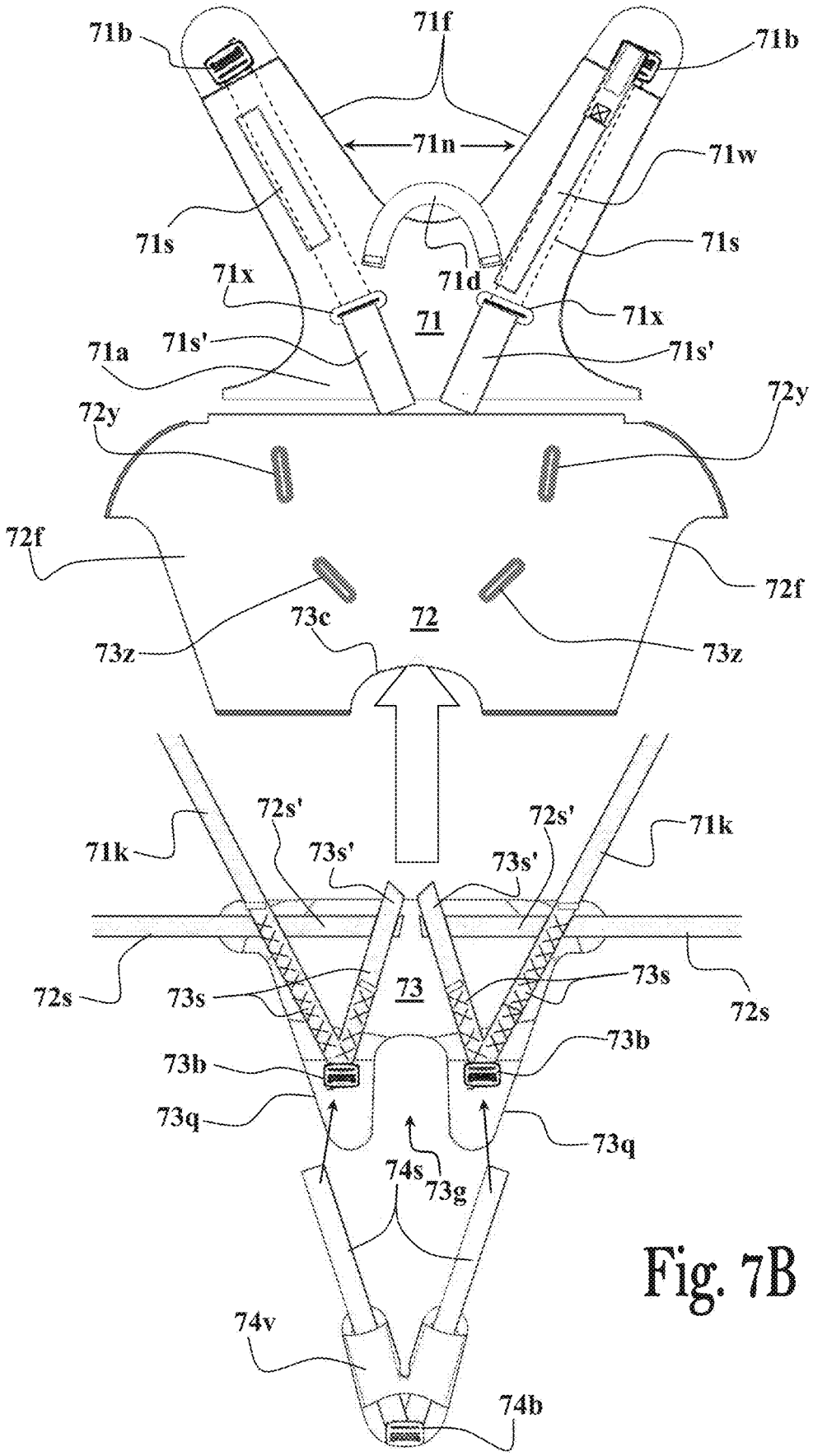

The shoulder, abdomen and intermediary straps of the harness 70, are attached, or embedded in, one or more covers/pads arranged for cushioning the harness for user comfort, and prevent suspension trauma which may be caused during the fall by straps pressed against the limbs and/or torso of the harnessed user. With reference to FIG. 7B, the harness may comprise an upper pad 71 configured to pad upper shoulder and chest regions of the harnessed user. The upper pad 71 comprises two spaced apart arms 71*f* converging into a base section 71*a* of the pad 71. The arms 71*f* of the pad 71 are configured to accommodate the shoulder straps 71*s* and define a gap 71*n* between them configured to receive the neck of the harnessed user therein. In this non-limiting example the upper pad 71 comprises two slits 71*x* at its base section 71*a* for passing the end portions 71*s*' of the shoulder straps 71*s* from the inner (or interior) side of the pad 71 to its outer side for connection to the suspension device 5.

A handle 71*d* may be attached to the upper pad 71 of the harness 70 (and/or to the back piece 75) to provide convenient grip of the harness. The connection of the different straps of the harness 70 between themselves, and/or to other parts/elements of the harness can be carried out by stitching, welding, rivet/bolts, adhesive materials, or combinations thereof. Adjustable strap connectors (e.g., having slide buckles) may be used for connecting some of the straps of the harness 70 to enable easy size adjustment of parts of the harness 70 to the user's body.

The base section of the upper pad 71 is connected to a middle pad 72 configured to pad back regions of the harness user. The middle pad 72 is generally of trapezoidal shape which major base is used to connect to the upper pad 71 and define two side flaps 72*f* configured for wrapping the sides (waists) of the harnessed user. The middle pad 72 comprises two spaced apart slits 72*y* at opposite sides near the major base for passing the end portions 72*s*' of the abdomen straps 72*s* from the inner (or interior) side of the pads to the outer side for attachment to the suspension device 5. Two additional spaced apart slits 73*z* provided in the middle pad 72 below the slits 72*y* are used for passing the end portions 73*s*' of the intermediate straps 73*s* from the inner (or interior) side of the pads to the outer side for attachment to the suspension device 5.

A lower pad 73 comprising the waist straps 72*s* and the intermediary straps 73*s* (e.g., attached to it by stitches) is used for padding middle and lower back regions of the harnessed user. The lower pad 73 is also generally of trapezoid shape, having a major bases region configured to fit for attachment beneath a minor base region of the middle pad 72, and two spaced apart legs 73*q* extending downwardly from its minor base. The trapezoidal shape of the lower pad 73 is configured to accommodate the V-shaped structures of the intermediate straps 73*s*, such that the arms of each intermediate strap 73*s* are sideways spread towards its major base portion, and the apex of each intermediate strap 73*s*, with the slide buckles 73*b* attached to it, is located in a respective leg 73*q* extending from the minor base portion of the lower pad 73.

Figure 7C:
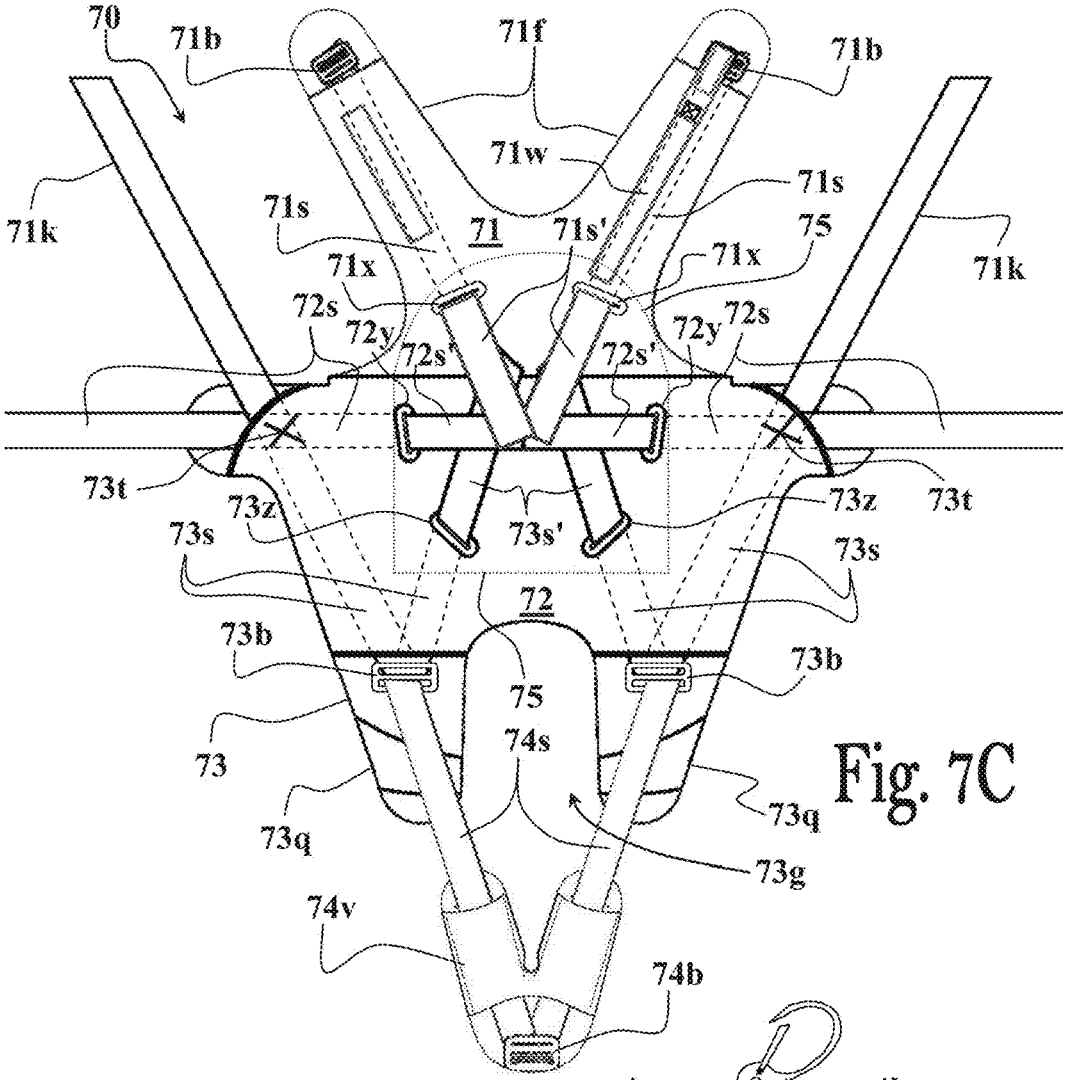

As also seen in FIGS. 7B and 7C, each arm of the V-shaped crotch assembly formed by the crotch straps 74*s* is configured to connect to the slide buckles 73*b* of a respective intermediary strap 73*s*. The V-shaped crotch assembly may also comprise a V-shaped pad 74*v* having at each arm thereof a sleeve configured for passage of a respective crotch strap 74*s* therethrough.

In this non-limiting example the abdomen straps 72*s* are attached at the major base region of the lower pad 73, and extend therefrom in opposite lateral directions. The intermediary straps 73*s* and the abdomen straps 72*s* may be connected (e.g., by stitches 73*t*) to each the other at their intersection areas at the extremities of the major base of the middle pad 72. As also seen in FIG. 7C, The lower pad 73 is placed underneath the middle pad 72 such that the gap 73*g* formed between its legs 73*q* is aligned with an arc-shaped indentation 73*c* formed in the center of the minor base region of the upper pad 71.

FIG. 7C shows the harness 70 after attaching the upper pad 71 and the lower pad 73 to the middle pad 72, and passing the end portions of the shoulders, abdomen and intermediate straps, 71*s*', 72*s*' and 73*s*', respectively, through their respective slits, 71*x*, 72*y* and 73*z*. As also seen in FIG. 7C, the loop adjustment strap 71*k* may be connected to the abdomen straps 72*s* and /or the intermediary straps 73*s* at the extremities of the major base of the middle pad 72 (e.g., by stitches 73*t*). Optionally, each loop adjustment strap 71*k* is a continuation of a respective intermediary strap 73*s*, being together a unitary unsegmented strap. Also, a cable holder sleeve 71*w*, for holding the portion of the cable 4 released from the suspension device before use, may be quickly opened (e.g., by Velcro attachment) for releasing the cable 4 therefrom.

Figure 7D:
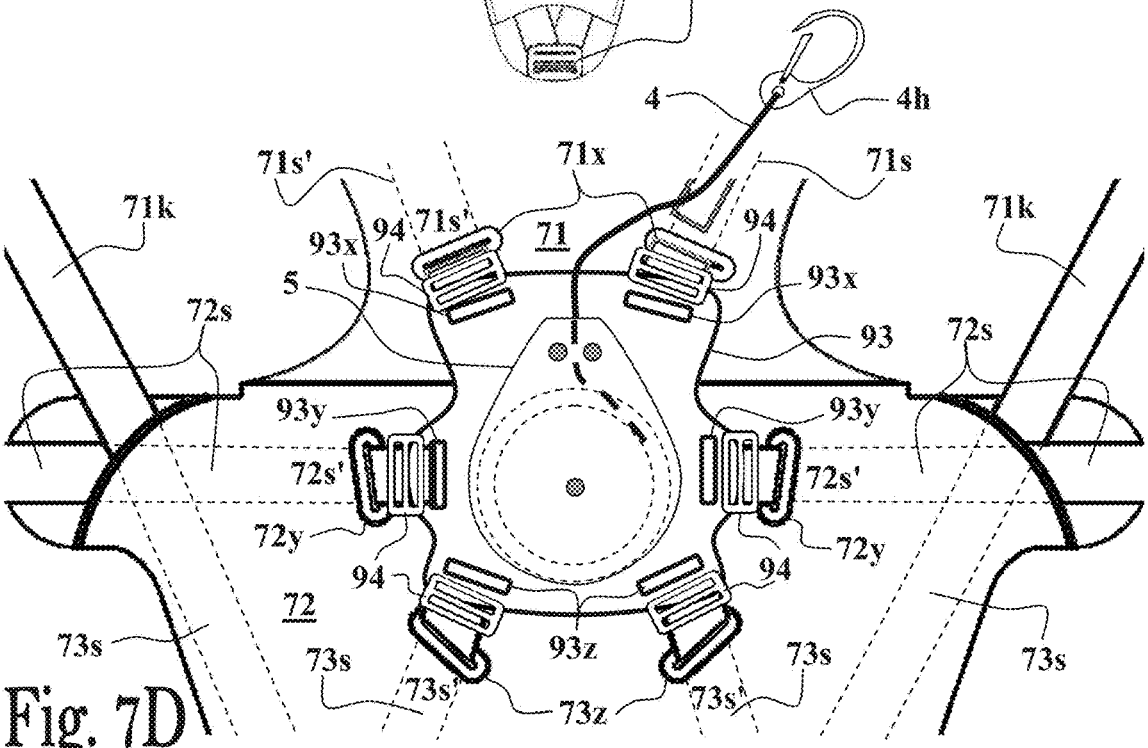

Referring now to FIG. 7D, the strap system is designed such that the end portions of shoulder straps 71*s*', the abdomen straps 72*s*', and the intermediary straps 73*s*', are connected inside the backpack 75 to a descent device e.g., drum device, 5, by means of circumferentially arranged strap slots (93*x*, 93*y*, 93*z*), thereby defining a suspension area of the device about the middle, or middle-upper back area (near the shoulder blades) of the harnessed user. For example, and without being limiting, the end portion 71*s*', 72*s*' and 73*s*', of each shoulder, abdomen and intermediary strap is passed through its respective slot 93*x*, 93*y*, 93*z*, and secured to itself by straps connecting means 94 (e.g., using a slide buckle).

Optionally, and in some embodiments preferably, the suspension device is a drum device 5 attached to a suspension plate 93 (e.g., made of metal and having a thickness of about 1.5 to 2 mm) in which the strap slots 93*x*, 93*y* and 93*z* are formed. In this non-limiting example, the suspension plate comprises two side slots 93*y*, located at opposite lateral sides of the plate 93 for connection of the two abdomen straps 72*s* thereto, two spaced apart top slots 93*x* located in an upper region of the plate 93 for connection of the two shoulder straps 71*s* thereto, and two spaced apart bottom slots 93*z* located in a lower region of the plate 93 for connection of the two intermediary straps 73*s* thereto.

The strap slots 93*x*, 93*y* and 93*z*, may be formed in peripherally distributed ears of the suspension plate 93. This arrangement of the straps connected to the suspension plate 93, and the attachment of the crotch (74*s*) and shoulder (71*s*, via the loop adjustment straps 71*k*) straps to the abdomen straps 72*s*, guarantees that the load of the harnessed user is evenly distributed between the various straps. In addition, the location of the drum device 5 at an upper back region of the harnessed user may be used to cause a forward nose-down tilt posture of the user's body during descent.

Figure 8A:
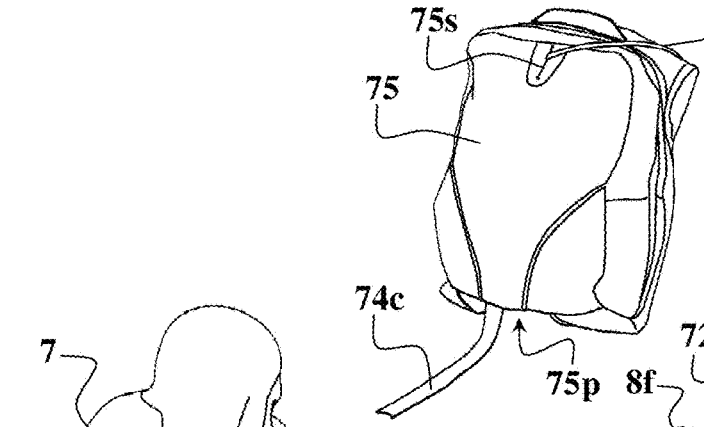
FIGS. 8A to 8N schematically illustrate step by step use of a CDD employing the harness arrangement shown in FIGS. 7A to 7D.
Figure 8B:
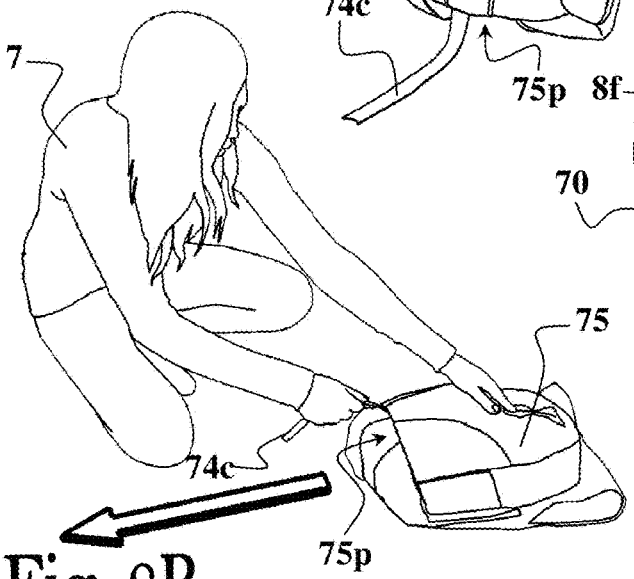
Figure 8C:
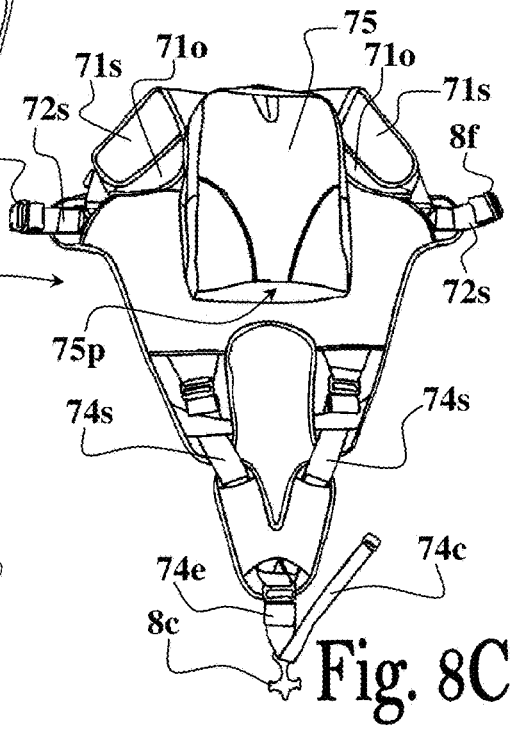
Figure 8E:
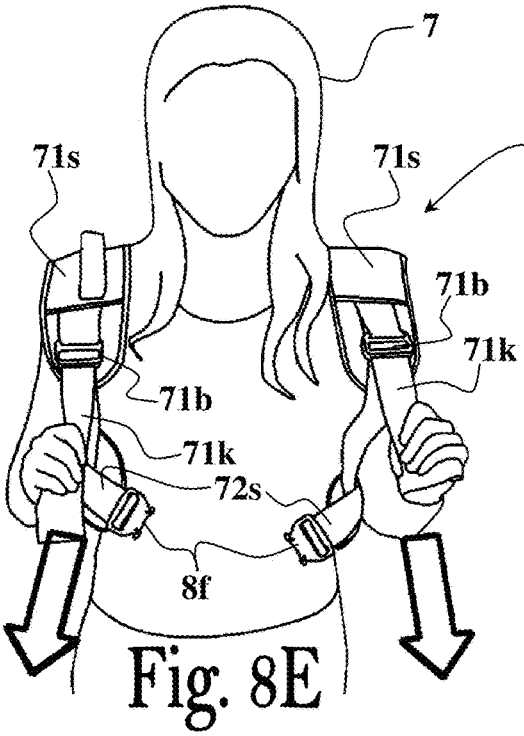
Figure 8D:
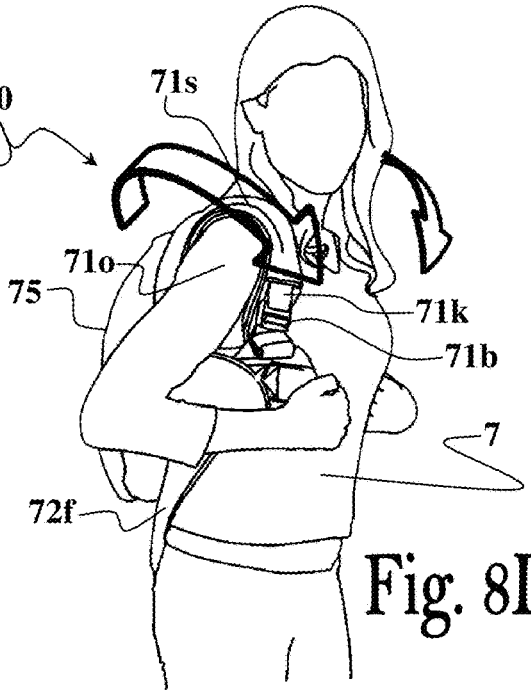
Figure 8F:
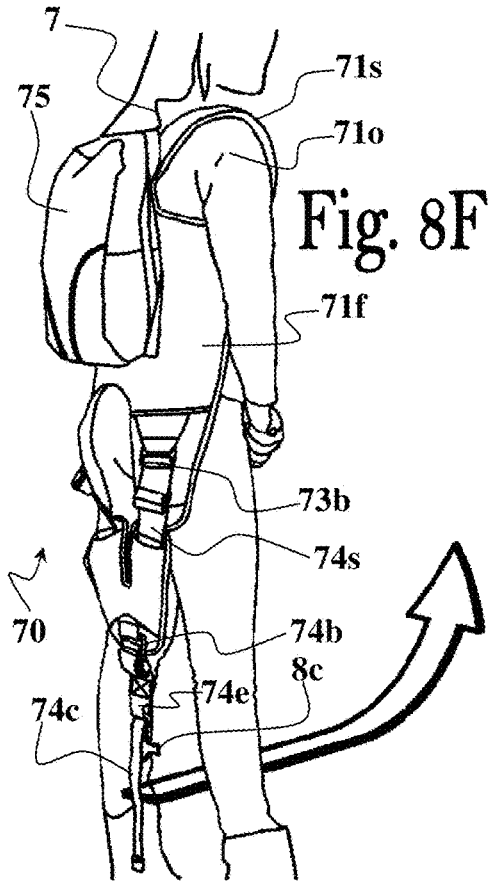
Figure 8G:
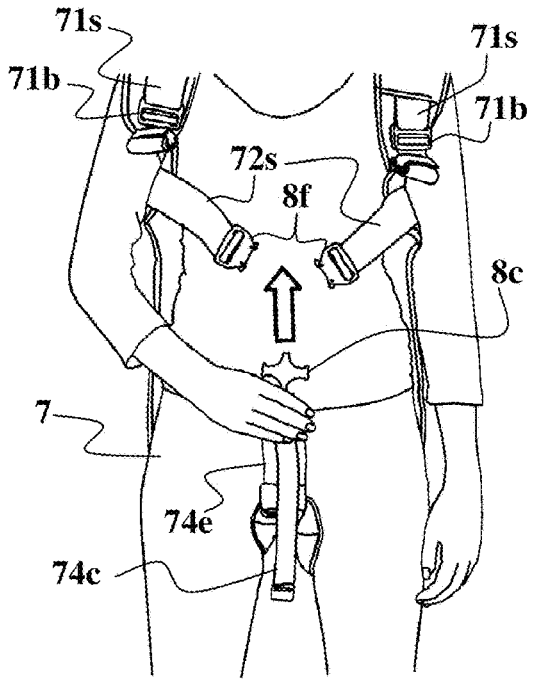
Figure 8H:
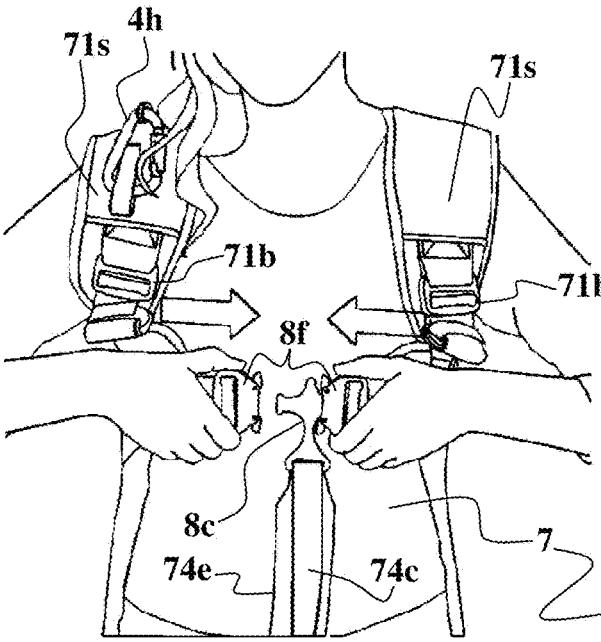
Figure 8I:
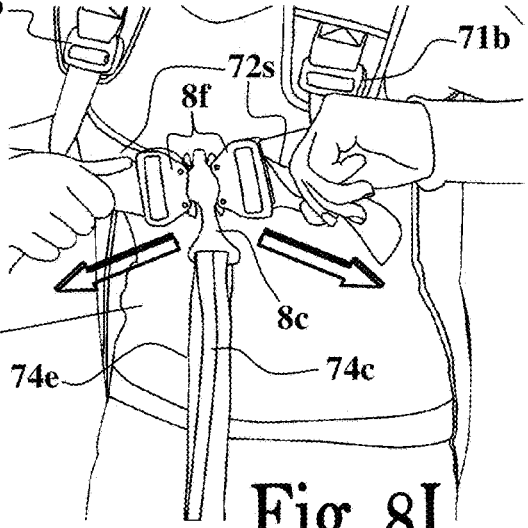
Figure 8J:
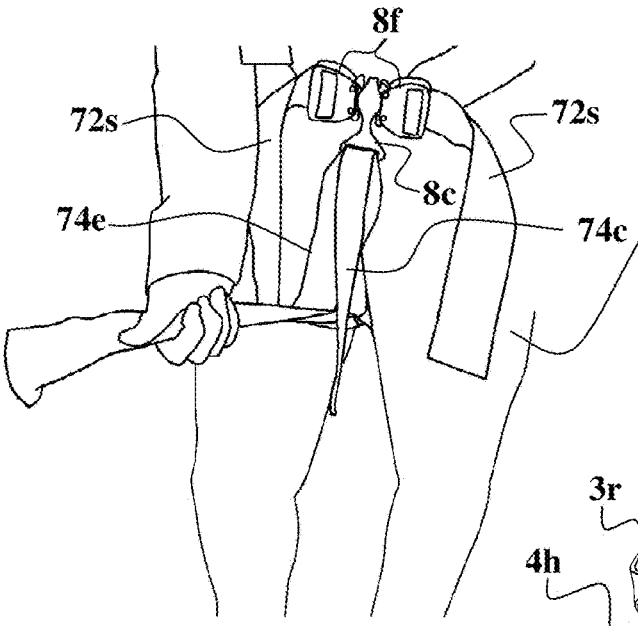
Figure 8K:
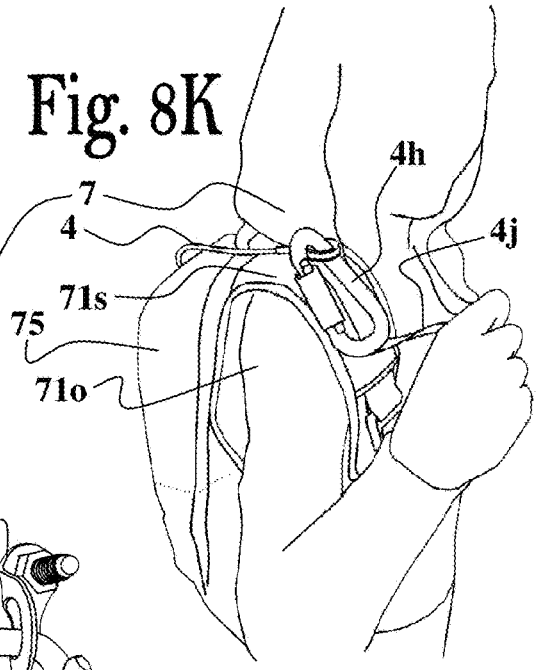
Figure 8L:
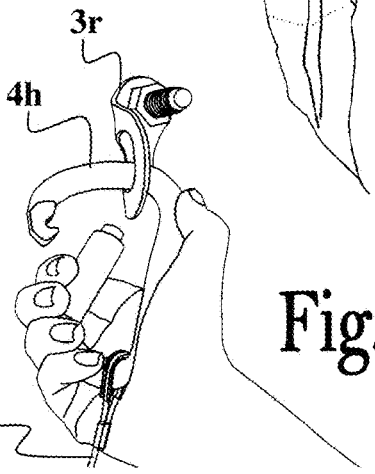
Figure 8M:
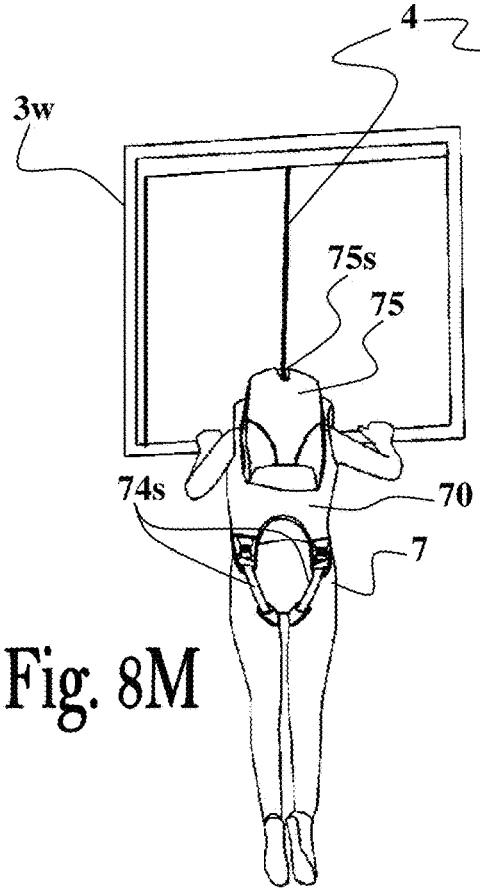
Figure 8N:
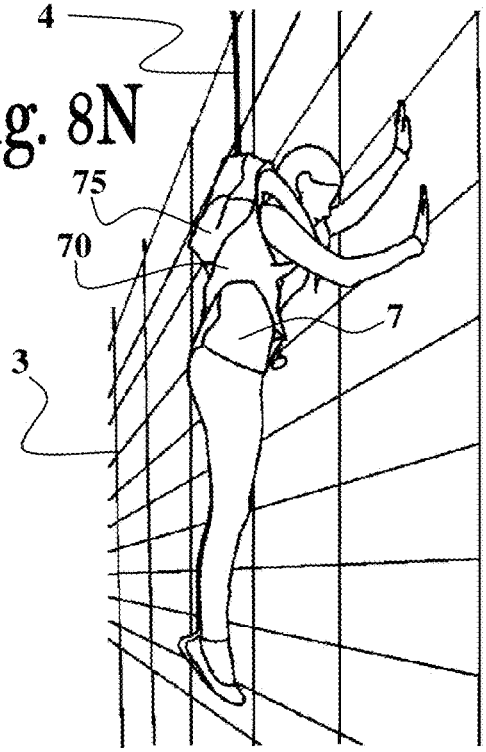

FIGS. 8A to 8N schematically illustrate step by step use of the CDD shown in FIGS. 7A to 7D. In FIG. 8A the harness 70 is seen in an undeployed state of its various straps and with the crotch straps (74*s*) in a folded state inside the bottom pocket 75*p* of the backpack 75. A pulling band 74*c* attached to the crotch straps (74*s*) is seen emerging from the bottom pocket 75*p* of the backpack 75 so as to provide a quick release of the crotch strap in an emergency situation, as exemplified in FIG. 8B. After pulling out the crotch straps 74*s* from the bottom pocket 75*p* the harness 70 is changed into a deployed state seen in FIG. 8C, by spreading the shoulder (71*s*) and the abdomen (72*s*) straps and revealing the shoulder loops 71*o*.

Next, harness 70 is donned by the user 7 by fitting the shoulder loops 71*o* over the shoulders, as shown in FIG. 8D. The size of the shoulder loops 71*o* may be then adjusted by pulling, or releasing, portions of the loop adjustment strap 71*k* through their attachment means 71*b* to the shoulder straps 71*s*, as exemplified in FIG. 8E. Referring now to FIGS. 8F to 8H, the harnessing of the user 7 requires passing the crotch straps 74*s* between the legs of the user 7, and attaching the connecting elements 8*f* provided at the free ends of the abdomen straps to quick connector 8*c* at the apex of the V-shaped crotch strap structure. As seen, in this way all straps of the harness 70 become connected by means of a single quick connecting assembly, allowing speedy harnessing of the user, and speedy release therefrom upon reaching safe ground. In FIG. 8I the abdomen straps 72*s* are adjusted (e.g., by slide buckles provided in the connecting elements 8*f*) to tightly fit the harness straps' over the torso of the user, and in FIG. 8J the size of the crotch assembly is adjusted by the adjustable strap 74*e* connecting the quick connector 8*c* to the crotch straps 74*s*.

After the user is harnessed, the anchor fastener 4*h* is released from the shoulder strap 71*s*. In FIG. 8K the user utilizes a release band 4*j* to pull the anchor fastener 4 and remove it from the shoulder strap 71*s*, and in FIG. 8L the user connects the anchor fastener 4*h* to an anchor member 3*r* provided in a wall of the high structure 3. The user exits in FIG. 8M the high structure 3 through the opening/window 3*w*, and in FIG. 8N, safely descends down to safe ground.

Figure 9A:
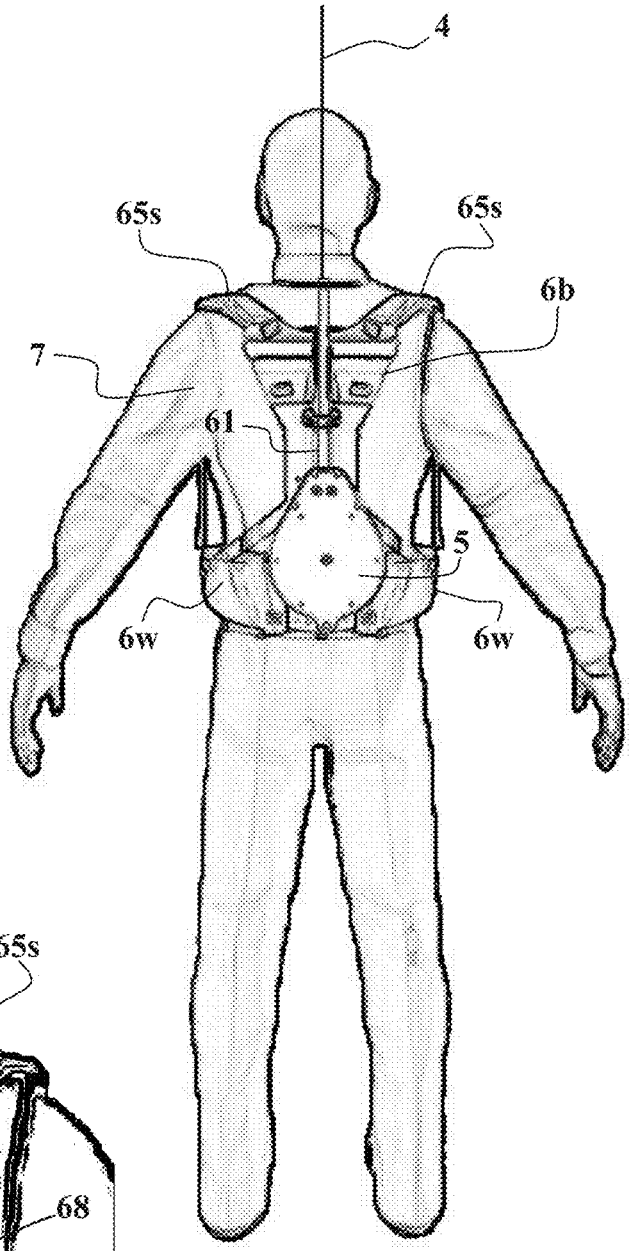
FIGS. 9A and 9B depict back views of a CDD arrangement according to some possible embodiments wherein the drum device is mounted at a lower back area of the harness.
Figure 9B:
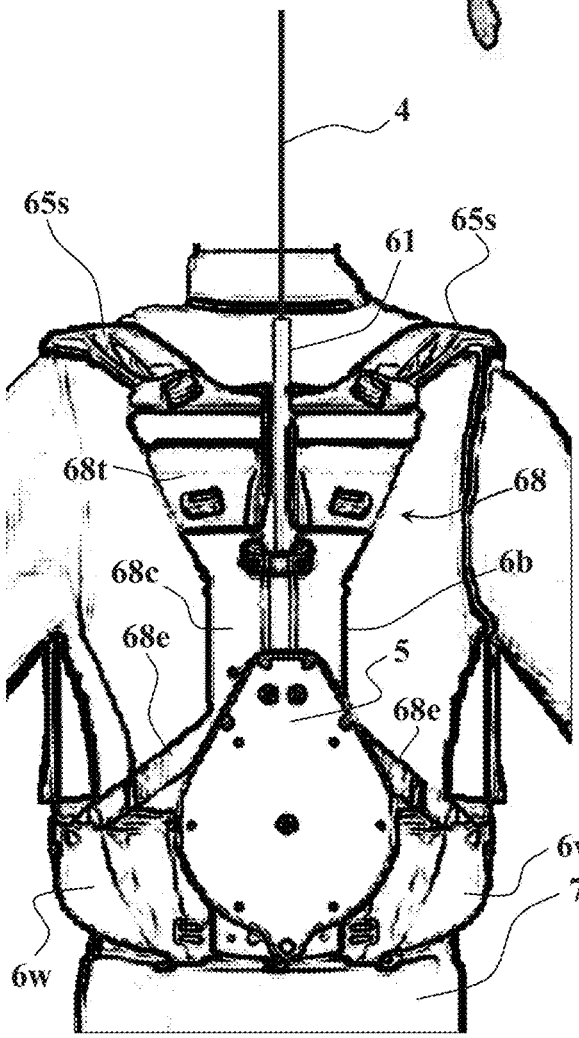

FIGS. 9A and 9B depict back views of a CDD according to some possible embodiments wherein the drum device 5 is mounted at a lower back area of the harness. In this non-limiting example, the harness includes two spaced apart shoulder straps 65*s* attached to the upper side of a back piece 6*b* and configured to wrap around the shoulders of the harnessed user 7, and two waist pieces/straps 6*w* configured to wrap around waist regions of the harnessed user 7. The shoulder straps 65*s* may be connected to waist straps 6*w* over an abdomen region of the user using a type of quick connection unit.

The back piece 6*b* of the harness may be implemented by a plate 68 (e.g., made from a suitable metal and having a thickness of about 1.5 to 2 mm) having a relatively wider width at its upper portion, and whose width is gradually reduced towards its lower portion along section 68*t*, until assuming a constant width along a subsequent section 68*c* of the plate passing along the lower back side of the harness. As better seen in FIG. 9B, the lower part 68*c* of the plate 68 having substantially constant width includes two lateral legs 68*e* extending downwardly therefrom in sideway directions and respectively attached to the waist pieces/straps 6*w* of the harness.

As exemplified in FIG. 9A and 9B, this configuration of the back piece 6*b* may be advantageously used to mount the drum device 5 directly over the lower back region of the harnessed user. More particularly, the back plate 68 may be configured to provide secured connection for the drum device 5 at the lower part of its constant width section 68*c*, near the location of attachment of the lateral legs 68*e* thereto, or between the lateral legs 68*e*. In some possible embodiments the CDD includes a cable guide 61 (e.g., sheath or conduit) attached along the length of the back plate 68 for preventing contact with the cable 4 by the user and by parts of the CDD located above drum device 5 and assuring smooth and obstacle-free cable release during descent.

Figure 10A:
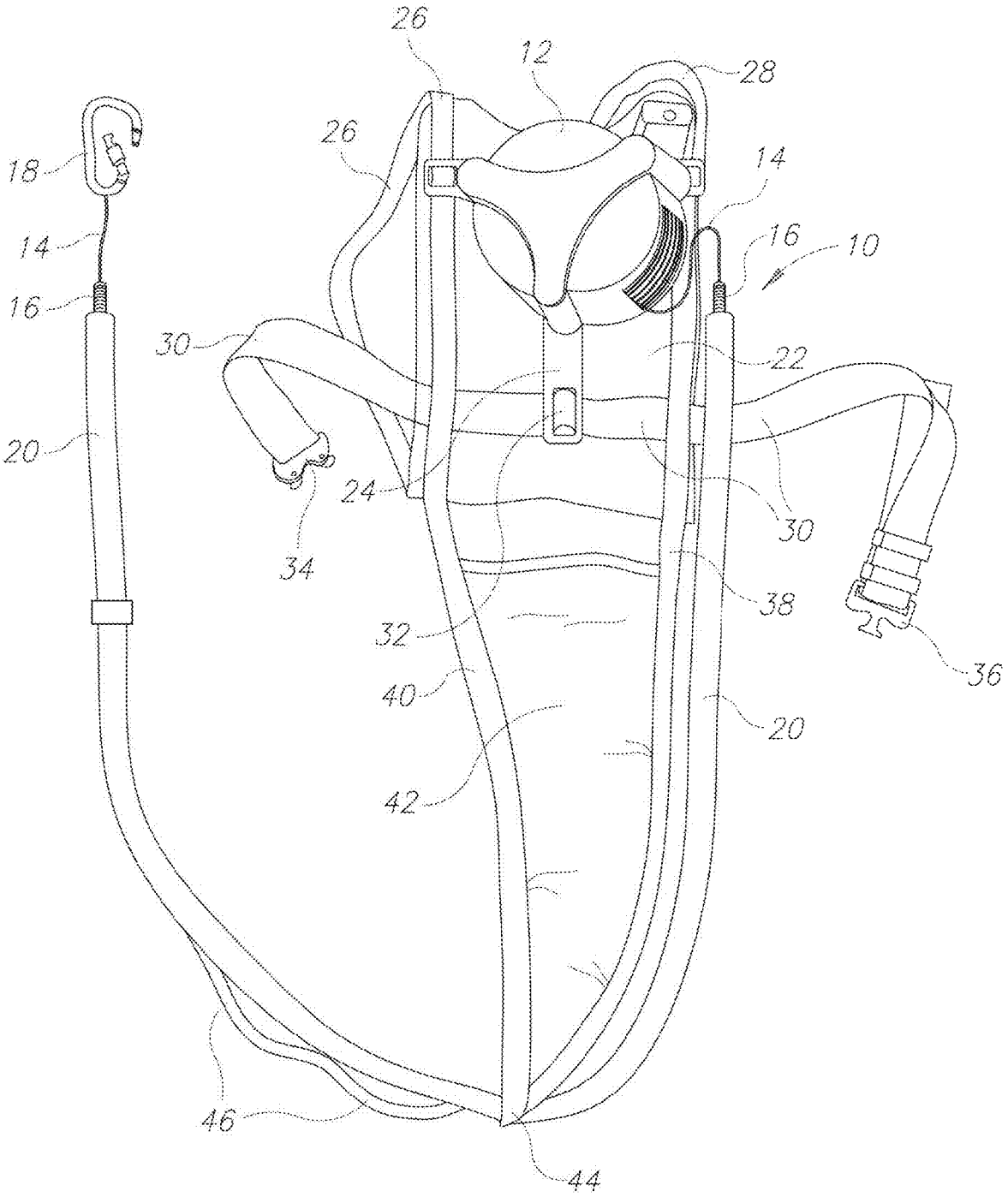
Figure 10B:
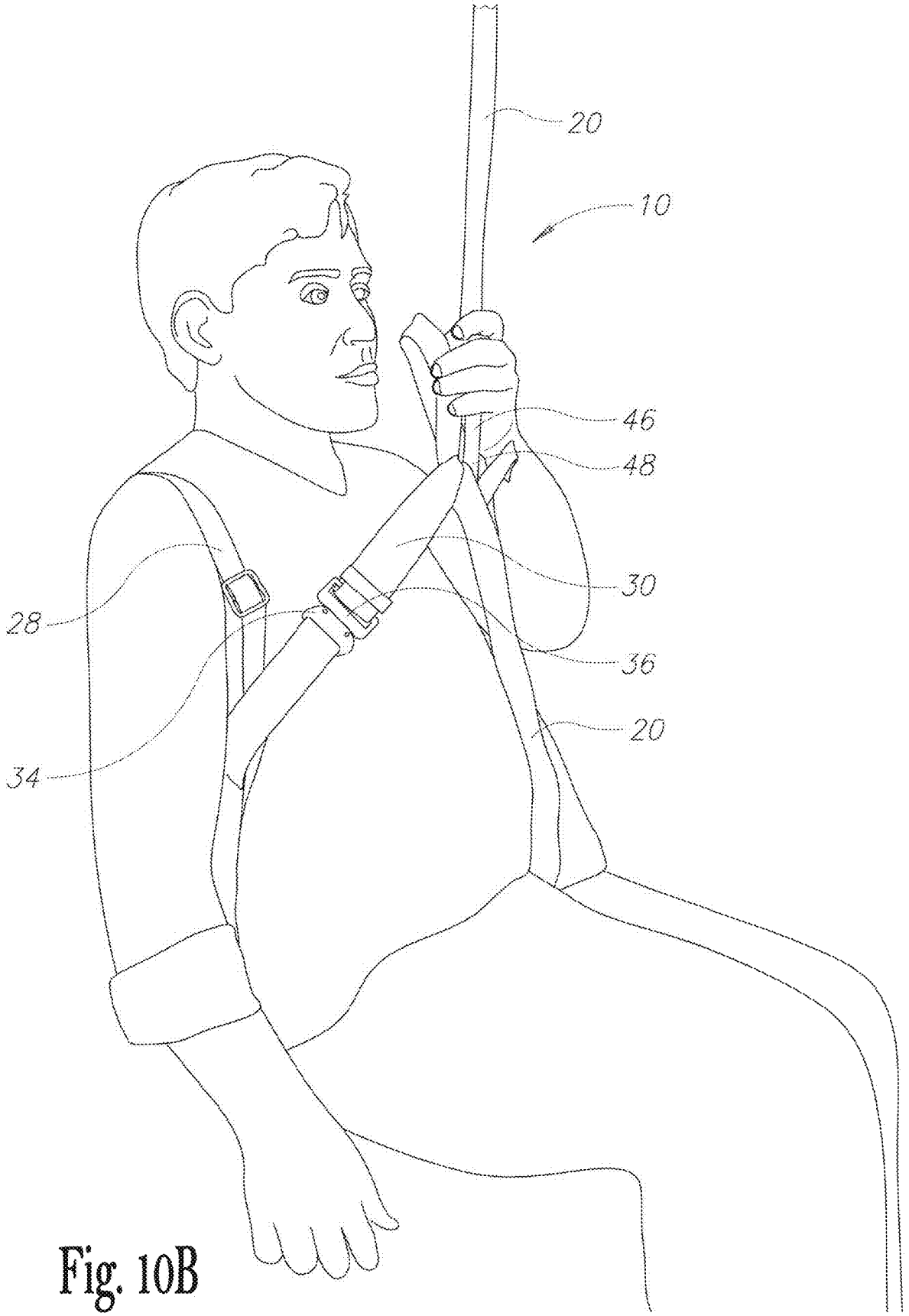
Figure 10C:
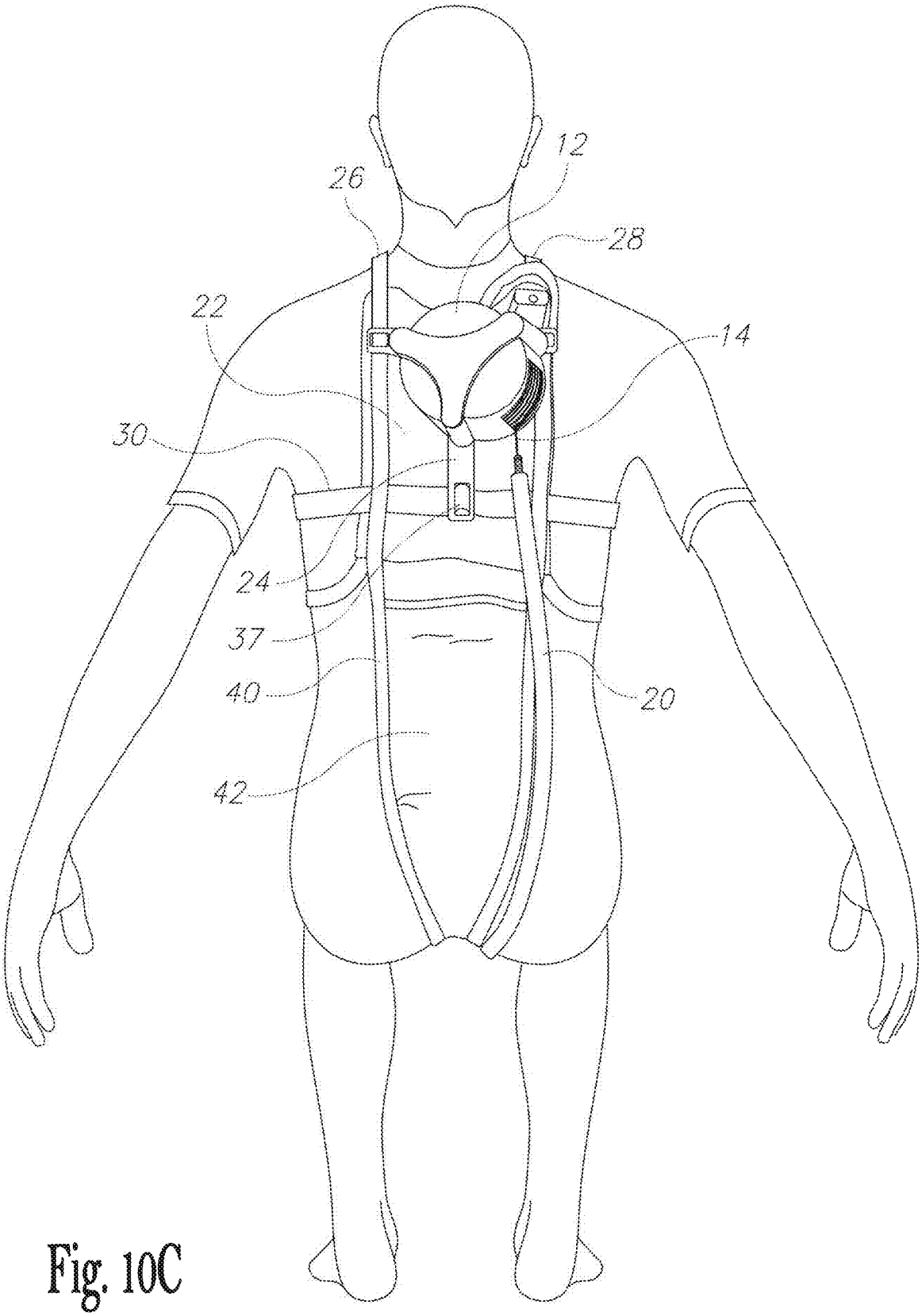

FIGS. 10A to 10C schematically illustrate a CDD arrangement according to possible embodiments configured for a reclining descent position. FIG. 10A schematically depicts a CDD 10 comprising a drum device 12, a cable 14, a cable conduit 16, an anchor fastener 18, a sheath 20, a back piece 22, a harness mount 24, a left shoulder strap 26, a right shoulder strap 28, a chest traverse strap 30 a strap fastener 32, a female fastener 34, a male fastener 36, a right crotch strap 38, a left crotch strap 40, a harness seat 42, a harness conjugation 44 and chest loops 46.

The drum device 12 comprises a spool of cable configured to release a cable at a controlled speed upon reeling out of the cable from the drum. The drum device may be equipped with a centrifugal braking mechanism as described hereinabove configured to control the speed of cable release from the drum device by applying friction forces by brake shoes.

The conduit 16 is configured to allow cable 14 to slide through it. The conduit 16 may be made from a substantially rigid or flexible tubing having a diameter slightly larger than the diameter of the cable 14. For example, and without being limiting, the conduit 16 may be made from metal or plastic material, optionally with an additional inner sleeve made of a material having a low coefficient of friction with the cable 14. Since the cable 14 is configured to hold the user's weight and this force is transferred via the cable guide assembly, if the conduit diameter is large, relative to the cable diameter, the force will be concentrated on a relatively small area of the conduit, thereby potentially impacting the structural integrity of the conduit. According to an embodiment of the invention, the conduit inner diameter is similar to the cable outer diameter such that it maximizes the area (relative to the conduit diameter) upon which the force is concentrated. Alternatively the metal of the conduit may be a self-lubricating metal or plastic which reduces friction. In addition, a lubricant may be applied to the cable and/or to the conduit 16.

The conduit 16 may optionally be enclosed or partially enclosed by a sheath 20 to assist in affixing the conduit to the CDD. The sheath 20 may be attached, for example, by sewing to crotch strap 38 or 40 or harness seat 42 to enable passage of the conduit 16 from the user's back side to the user's front side between the user's legs. In some embodiments the sheath 20 comprises a synthetic fabric material.

The cable 14, at its distal end (after passing through conduit 16) is attached to the anchor fastener 18, which may comprise a carabineer, loop, hook or similar device configured to be fastened to an anchor located in or in the proximity of the high structure being escaped from. The anchor fastener 18 may comprise a quick-release device which can be rapidly secured to an anchor.

The back piece 22 may comprise a synthetic fabric material to which straps may be affixed, for example, by stitching. The harness mount 24 may be affixed to the drum device 12 and to the back piece 22 of the harness. Left shoulder strap 26 and right shoulder strap 28 may be affixed to the back piece 22 of the harness, for example, by stitching. The shoulder straps 26 and 28 may be configured to attach to the back piece 22 at an upper end and at a lower end, thereby forming shoulder loops configured to fit snugly around the shoulders of the user.

The straps 26, 28 and/or 30 may be adjustable by buckles, for example spring loaded buckles, for easy length adjustment. Such spring-loaded buckles may be configured to prevent loosening of straps under substantial force, for example, gravitational forces acting on a human exiting from a high structure. The straps 26, 28 and 30 may be attached to the back piece 24, for example by looping through loops provided in the back piece 24 of the harness, for example by using the strap fastener 32.

The chest traverse strap 30 may be fitted with interlocking fasteners which are configured to remain interlocked under substantial force. For example, chest traverse strap 30 may be fitted at one end with a male fastener 32 and at the other end with a female fastener 34 which interlock. The interlocking fasteners may comprise a safety mechanism to prevent inadvertent opening of the fasteners.

The crotch straps 38 and 40 may be attached to harness seat 42 (e.g., a triangular piece of durable fabric), for example, by stitching. The harness seat 42 may have a wide side attached to the lower side of the back piece 22 of the harness, and may narrow to a narrow end at the end of the harness seat opposite the wide side, near harness conjugation 44. Harness seat 42 may comprise padding.

The right crotch strap 38 and the left crotch strap 40 may overlap or meet at harness conjugation 44 at which point crotch straps may be sewn together. Optionally, one or both of the crotch straps may continue distally from harness conjugation. At the conjugation 44, the sheath 20 and/or the conduit 16 may also be affixed. The sheath 20 may also be fitted with chest loops 46 attached to the sheath 20 configured to accommodate the chest traverse strap 30 passing through it. Optionally the chest loops 46 are provided at a point distal from conjugation 44. Alternatively or additionally, the crotch strap may comprise chest loops 46 at a point distal from conjugation 44.

During its operation, for example in an emergency situation in which escape from a high structure is necessary, the CDD 10 is easily and quickly donned and secured as follows. A user may remove the CDD from a secure location and optionally remove a protective wrapping (not shown) from the CDD. A user may place his left arm through shoulder loop formed by left shoulder strap 26 and the back piece 22 of the harness. A user may then place the right arm through shoulder loop formed by right shoulder strap 28 and the back piece 22 of the harness. The user may then tighten shoulder straps 26 and 28, for example, by tightening shoulder strap at a spring-loaded buckle (not shown) so that the back piece 22 is secured onto the user's back. Donning CDD in this fashion resembles putting on a back-mounted pack (also known as a back pack, or rucksack.) This manner of donning the CDD is intuitive to a user and allows the user's shoulders and back to bear much of the weight of the CDD, which stems from the weight of the cable 14 and drum device 12.

After donning and securing the shoulder straps 26 and 28, the harness seat 42 will be located adjacent to user's rear end. A user may reach between his legs and pull harness seat 42 between his legs, optionally by raising a crotch strap or a sheath 20 at a point distal from harness conjugation 44. The user may continue to raise a crotch strap or sheath 20 so that chest loops 46 are roughly at chest level.

As opposed to other full body harnesses which comprise individual loops to secure each leg, the CDD 10 comprises a harness seat 42 on the lower end which narrows to a narrow width that is easily held in one hand. The harness seat may be brought from the user's back side, between the legs to the user's front side. This narrow end or single sheath, once brought to the user's front side, may be easily held and secured quickly into position to ensure rapid donning of the CDD, without the need for multiple fasteners. This rapid and quick feature of embodiments of the invention may be useful in harnesses used in self-rescue systems which are put on under duress of an emergency, with potentially limited visibility in the dark or in smoke.

Chest traverse strap 30 may be configured so that after donning the CDD 10, the chest traverse strap 30 is at a height corresponding to a user's lower chest, below a user's breast. A user may then extend an end of the chest traverse strap 30 through a loop 46. The user may then secure male fastener 36 to female fastener 34, thereby configuring the chest traverse strap 30 as a closed loop. The formed closed loop may be tightened (for example, via a buckle) to a point that it is about 10 cm longer than a user's chest circumference. For the sake of convenience, the user may be instructed to tighten the loop formed by chest traverse strap 30 while keeping a clenched first between the chest traverse strap 30 and the user's chest, thereby leaving approximately 10 cm of slack in the chest loop.

The user may then attach anchor fastener 18 to an anchor embedded in a high structure from which attempting to descend. The anchor may be a hook firmly secured to a wall or to a floor of the structure. After donning the CDD 10 and firmly fastening anchor fastener 18 to an anchor, a user is prepared to descend from a high structure.

The user may then exit the high structure, for example, by climbing out of a window which opens to the outside of the high structure. Upon a user's exit and extension of the cable 14 from the drum device 12, and gravitational forces pulls the user in the downward direction, a centrifugal brake in the drum device 12 may slow down descent of the user by slowing release of the cable 14 from the drum device 12.

FIG. 10B schematically depicts a perspective side view of a user descending while using the CDD according to a possible embodiment, wherein the CDD 10, while donned by the user, maintains the user in reclining position, preferably approximately 10-60 degrees from a vector parallel to the force of gravity. This positioning is advantageous to a user rapidly descending from a high structure in an emergency situation. A user descending in such a position may reduce risk of suspension trauma. In addition, the user can easily maneuver using the user's arms and legs, to avoid colliding with falling objects, other users descending from the high structure, and other architectural obstructions located on the outside of the structure, for example, balconies. The user may "bounce" off of the building by kicking with her feet. The user is also in a position in which user's lap and hands are free, and thus may exit the structure with an object, such as a pet in his or her lap.

FIG. 10B depicts, in addition to the elements described in reference to FIG. 10A, a weight bearing/suspension point 48. A reclining seated position while using the CDD is an effect of the positioning of the center of gravity of the user relative to weight bearing point 48 of the harness. Weight bearing point 48 of the harness is the point of convergence of chest traverse strap 30 and the sheath 20 (or conduit 16.) The center of gravity of a user in a seated position is in proximity to a user's buttocks. Since the CDD is configured to allow for slack in the chest strap, as gravitational force pulls a user in the downward direction, the center of gravity of the user will be located below the weight bearing point of the harness, thereby ensuring reclining positioning.

The CDD 10 may be advantageous as opposed to other devices having a drum device situated in front of the user, as the user of the CDD may hold on to sheath 20 while descending, as shown in FIG. 10B. Since the released cable 14 is protected by the conduit 16 and/or the sheath 20, the user does not risk friction burn from cable 14 as it is released from the drum device.

In some possible embodiments the CDD 10 may be used to provide front-side suspension used in a fall-arrest system. The CDD 10 may be used in conjunction with a safety lanyard (not shown) which may be connected on its distal end to a secure anchor on a structure and at its proximal end to a point on the CDD 10 located on the back of the user, for example the back piece 22 of the harness. The connection between the lanyard proximal end and the back piece 22 may be made via a carabiner or similar locking/unlocking device. When a user uses the CDD 10 in a situation in which fall-arrest is desired, the CDD 10 may be secured on the body of the user, but the anchor fastener 18 may not be connected to any anchor, rather it may be located at a location within easy reach of the user. If the user falls, for example from a scaffold located external to a high structure, the lanyard will prevent the user from falling to the ground, however, the worker will be in a face-down position, suspended from a lanyard connected to his back side. This position is dangerous as it may cause suspension trauma. Using the CDD 10, the user may move his hanging point to a front side thereof by connecting the anchor fastener 18 to a point at or near the proximal end of the lanyard, for example a ring near the proximal end of the lanyard. The user may then free the lanyard connection from the back piece 22 of the harness and then the user will be supported from weight in the bearing point 48 in the user's front. The user's weight will then cause the cable to reel out from drum device 12 thereby lowering the user safely to the ground. This upward facing reclining position is advantageous for control and safety when rappelling down a structure and may obviate risk of suspension trauma.

Figure 11A:
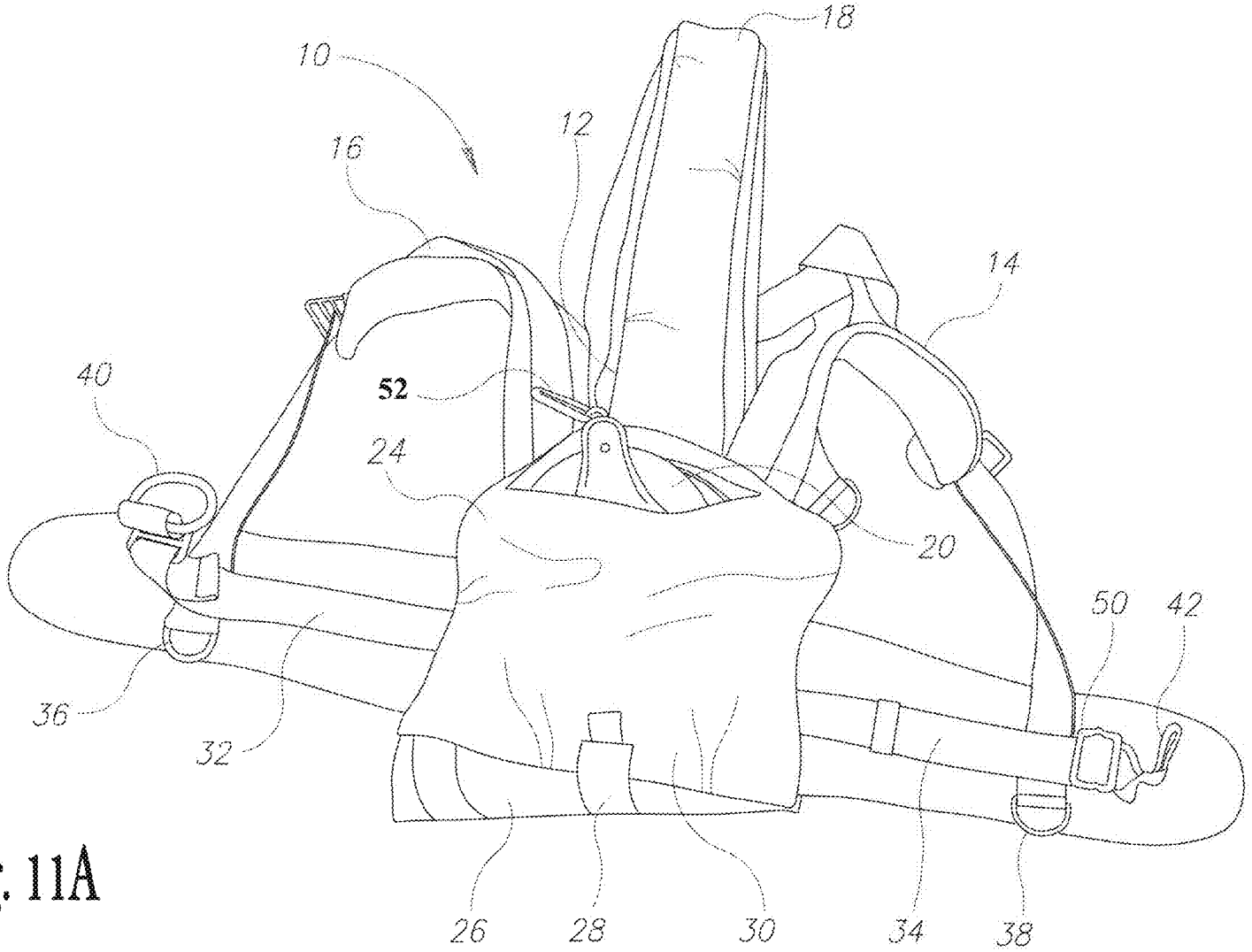
FIGS. 11A to 11C schematically illustrate a CDD arrangement according to possible embodiments wherein the drum device is releasably held in a pouch before using the CDD, and wherein FIGS. 11A
Figure 11B:
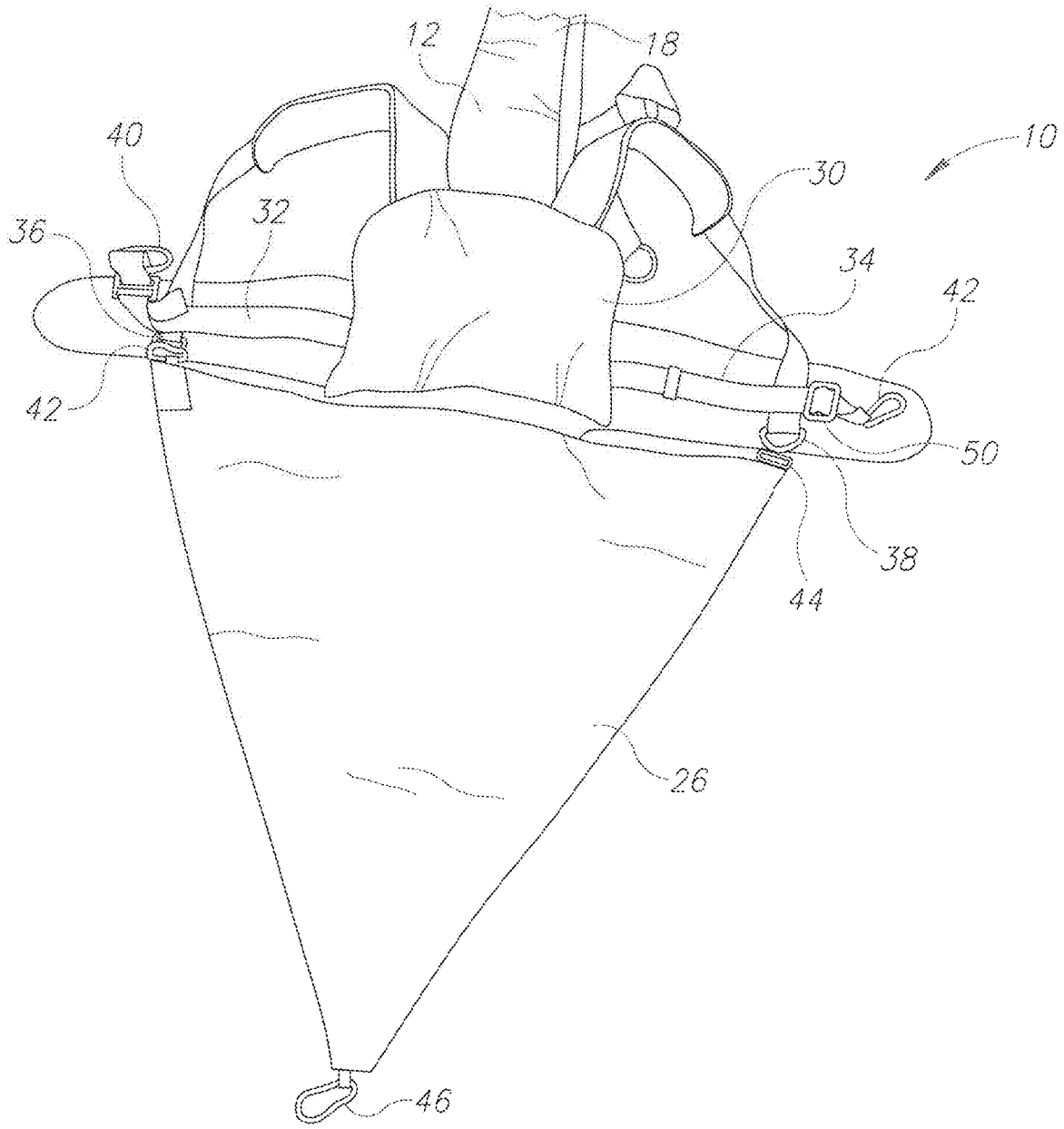
Figure 11C:
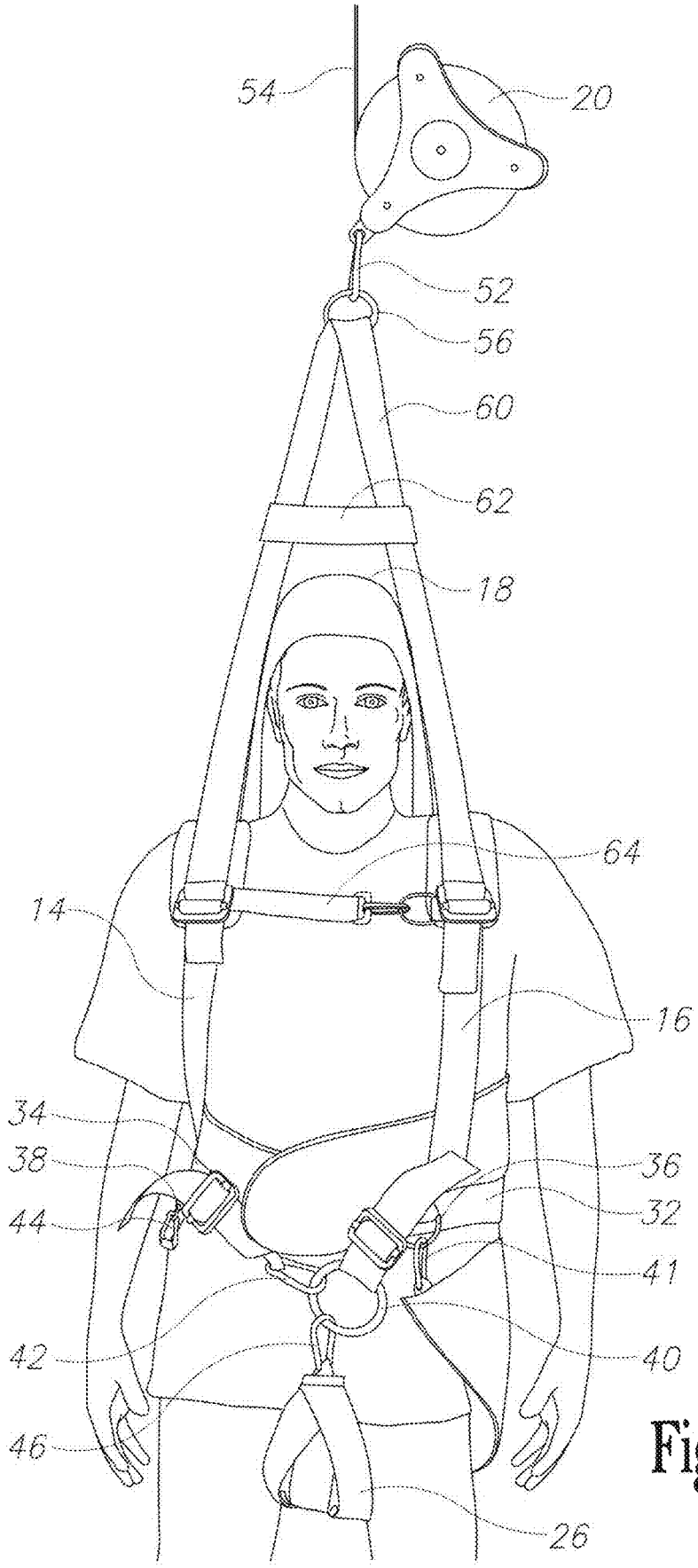

FIGS. 11A to 11C schematically illustrate a CDD arrangement according to possible embodiments wherein the drum device is releasably held in a pouch before using the CDD. As shown in FIG. 11A the CDD 10 comprises a back piece 12, a right shoulder strap 14, a left shoulder strap 16, a hood 18, a drum device 20, an upper pouch 24, a crotch support 26, a pouch fastener 28, a lower pouch 30, a left waist strap 32, a right waist strap 34, support rings 36 and 38, a harness ring 40, a harness connector 42 and a harness fastener 50.

The back piece 12 may comprise a synthetic fabric material, to which straps may be affixed (e.g., by stitching), and a padding material to add comfort to a user while wearing the CDD 10. Shoulder straps 14 and 16 may be affixed to harness back piece 12 (e.g., by sewing), and may be adjustable by buckles (e.g., spring loaded buckles), for easy length adjustment. Such spring-loaded buckles may be configured to prevent loosening of straps under substantial force, for example, gravitational forces acting on a human exiting from a high structure.

Hood 18 may be a head-protecting element attached to harness back piece 12 (e.g., by sewing), and comprising a rigid or semi rigid material (e.g., a padding material) configured to cover the head and/or neck of the descending user and protect the user's head from impact. The areas designed to be covered by hood 18 may include neck, back of head, sides of head and/or top of head.

In some possible embodiments, the drum device 20 comprises a spool of cable configured to release cable at a controlled speed upon reeling out of cable from the drum. The drum device may be equipped with a centrifugal braking mechanism which comprises revolving brake shoes that are driven outwards by centrifugal force generated upon release of cable and rotational movement of the spool, thereby contacting the brake shoes with the brake drum. The friction generated between the brake shoes and brake drum control the rotational movement of the spool and the speed of reeling out of cable.

The cable (not shown) may be coiled/spooled on a spool within drum device 20 such that one end of the cable is affixed to the drum and the other end (distal end) may be configured to attach to a secured anchor of the escaped structure before descent, via an anchor fastener (not shown). The anchor fastener may comprise a carabineer, loop, hook or similar device configured to be fastened to an anchor located in or in the proximity of a high structure. For example and without being limiting, the anchor fastener may comprise a quick-release device which can be rapidly secured to an anchor.

In some possible embodiments, the upper pouch 24 includes a recess having an opening in the upward direction (when worn by a user who is standing upright) and closures (not shown e.g., Velcro fasteners, snaps or suchlike) which are configured to keep the pouch closed but are configured to open upon motion of the drum device 20 in the direction of the closures. Additionally or alternatively, straps, cords or fasteners may be configured to detachably hold the drum device 20 on the back of the harnessed user before escaping the structure.

The drum device 20 is configured to be securely attached to the back piece 12 or to shoulder straps 14 and/or 16, and the drum device 20 may be attached to the CDD by, for example, straps (as shown in FIG. 11C).

The back piece 12 of the harness may be attached at its lower end to a crotch support piece 26 e.g., a triangular piece of flexible, durable material configured to harness a user's crotch area. Alternatively, crotch support piece may comprise straps, shorts or upper leggings or ropes configured to secure the user's crotch area. Crotch support piece 26 may be configured to be folded and fit in lower pouch 30. The lower pouch 30 may have an opening facing down (relative to a user standing in an upright position) and may optionally comprise a pouch fastener 28, configured to keep crotch support 26 contained in lower pouch 30. Pouch fastener 28 may comprise Velcro, snaps or similar closing mechanisms which can easily be opened by pulling downwards on a folded crotch support 26. The crotch support 26 may be configured to attach, in a folded conformation, to a lower end of the back piece 12 using straps, cords, fasteners or any other device suitable to removably hold crotch support 26.

The back piece 12 of the harness may be attached to a left waist strap 32 and to a right waist strap 34. The left waist strap 32 may comprise a support ring 36, configured to connect to the crotch support piece 26, and the right waist strap 34 may comprise a support ring 38, configured to connect to the crotch support piece 26. One of the waist straps may be attached to a harness ring 40, configured to secure the other waist strap via a harness connector 42 (e.g., a carabineer, a clip, a ring or any other suitable connector capable to detachably connect to harness ring 40 and withstand significant force while connected). One or both of the waist straps 32 and/or 34 may comprise a harness fastener 50 configured to adjust the length of a waist strap.

With reference to FIG. 11B, CDD 10 is shown with crotch support piece 26 unfolded and removed from lower pouch 30. As can be seen in the figure, crotch support piece is connected to the back piece 12 of the harness at the lower end of the back piece 12 by, for example, stitching. Alternatively, the back piece 12 and crotch support piece 26 may be formed of the same piece of fabric. The crotch support piece 26 may be configured to be wide at the end adjacent to the back piece 12 and narrow at the distal end.

The CDD 10 further may comprise harness connectors 41 and 44 (e.g., carabineers, clips, rings or any other suitable connector capable to detachably connect to support rings 36 or 38 and withstand significant force once attached), attached to crotch support piece 26 and configured to connect to support rings 36 and 38 respectively, thereby securing crotch support piece 26 to waist straps. The CDD 10 may further comprise harness connector 46 secured at the distal end of crotch support 26, and be configured to attach to harness ring 40 after crotch support piece 26 is drawn along the crotch of user.

During its operation, for example in an emergency situation in which escape from a high structure is necessary, CDD 10 is easily and quickly donned and secured as follows: the user may place the left arm through loop formed by the left shoulder strap 16 and the back piece 12, place the right arm through the loop formed by the right shoulder strap 14 and the back piece 12, and tighten shoulder straps 14 and 16 (e.g., by tightening shoulder strap at a spring-loaded buckle—not shown) so that the back piece 12 of the harness is secured onto the user's back. Donning the CDD 10 in this fashion resembles putting on a back-mounted pack (also known as a back pack, or rucksack.) This manner of donning CDD 10 is intuitive to a user and allows the user's shoulders and back to bear much of the weight of the CDD 10, which stems from the weight of cable and drum device 20.

After donning and securing shoulder straps in a standing position, the back piece 12 of the harness will be located on the user's back, and the user may then secure waist straps 34 and 32 by interlocking harness ring 40 with harness connector 42. The user may then reach behind his or her back and pull crotch support piece 26 downwards, thereby loosening pouch fastener 28 and removing crotch support 26 from lower pouch 30. A user may then reach between her legs, optionally by raising a narrow area of crotch support piece 26 which is distal from back piece 12 of the harness, and continue to raise the crotch support piece 26 bringing harness connector 46 to roughly chest level, and securing it to harness ring 40.

As opposed to other harnesses which comprise individual loops to secure each leg, CDD 10 may comprise the crotch support piece 26 which narrows to a narrow width that is easily held in one hand. This narrow end can be held and secured quickly into position to ensure rapid donning of CDD 10.

The user may further don hood 18 on her head in order to prevent head injury upon exiting a high structure, specifically head injury associated with drum device 20 or straps or cables associated with drum device 20 moving from behind the evacuee to her front side.

In some possible embodiments, the hood is arranged with a substantially hard layer to provide helmet like protection to the head from impact, and a softer, shock absorbing material to protect the head from concussion. Thus while rappelling down the building the user may collide with the structure or other evacuees, and hood 18 will offer protection by absorbing mechanical energy and protecting against any impact.

In use the user attaches the anchor fastener to an anchor embedded in a high structure from which descent is attempted, optionally reeling out the cable from a drum device. The anchor may be a hook firmly secured to a wall or to a floor of the structure in the proximity of a door, window or other exit route from a high structure. After donning CDD 10 and firmly fastening the anchor fastener to an anchor, a user is ready to descend from a high structure. The cable may be reeled out from the drum device 20 while the drum device 20 is located in upper pouch 24 as the user approaches an exit of the high structure.

The user may exit the high structure (e.g., by climbing out of a window which opens to the outside of the high structure). Upon the user's exit and extension of cable from the drum device 20, as the user descends in the downward direction, drum device 20 may be pulled upwards out of upper pouch 24 and may begin to unreel cable from drum device 20.

Reference is made to FIG. 11C, showing a front view of a user descending while using the CDD 10. The CDD 10 comprises drum connector 52, cable 54, strap connector 56, drum straps 60, strap separator 62 and chest traverse strap 64. Upon descent, cable 54 which is reeled within drum device 20 and attached at its distal end to anchor fastener (not shown in FIG. 11C, but shown in FIG. 11A) which is secured to an anchor, is configured to pull drum device 20 from upper pouch in the upwards direction. The drum device 20 is secured via drum connector 52 to strap connector 56. The strap connector 56 is fixedly attached to drum straps 60 which are fixedly connected to the back piece of the harness or to the shoulder straps. Upon upward movement of drum device 20 (relative to the user) to a position above the user's head, the drum straps 60 suspend the user below the drum device 20.

As the drum device 20 moves from a position behind the user to a position above the user (as shown in FIG. 11C), hood 18 protects the user's head from impact by the drum device 20. Strap separator 62 ensures that drum straps 60 are configured above and to the sides of user's head. Thus, as the user descends, the drum device 20 is maintained at a fixed distance above the user's head while reeling out cable 54 at a controlled rate, ensuring that the user descends safely from the structure.

Also shown, the chest traverse strap 64 securely maintains shoulder straps in place. Upon gravitational force being applied on the user in the downward direction, the cable 54 is reeled out from the drum device 20 in a controlled manner, and as a result, the user may descend at a controlled pace. During descent, a centrifugal brake mechanism provided in the drum device 20 may slow descent of the user by slowing release of cable 54 from the drum device 20.

According to a possible embodiment, as seen in FIG. 11C, the CDD 10, while donned by the user, maintains the user in a substantially upright position, preferably approximately 10 to 60 degrees from a vector parallel to the force of gravity (as defined by an imaginary line drawn from the user's shoulders to the user's hips). The positioning (angle) of the user while descending can be varied by moving the location of the connection between the drum straps 60 and the straps 14/16. This positioning is advantageous to a user rapidly descending from a high structure in an emergency situation. A user reclining in such a position may reduce risk of suspension trauma. In addition, the user can easily maneuver with her arms and legs to avoid colliding with falling objects, other users descending from the high structure and other architectural obstructions located on the outside of the structure, for example, balconies. Hood 18, which is configured to remain on the user's head during descent, is advantageous in that it prevents debris or other people descending from the high structure from injuring the user. In addition, the user may "bounce" off the building by kicking with the feet. The user is also in a position in which the lap and hands are free, and may exit the structure with an object, such as a pet in hands.

Many users of controlled descent devices are afraid of heights and are anxious while descending. In controlled descent devices in which a drum device is located in front of the user, a user may risk friction burn if the rapidly releasing cable is touched while descending. In the CDD of the present invention this risk is not present, as the drum device is positioned out of reach of the user (e.g., above a user's head) while the user is descending.

The CDD of the present invention may be used to provide front-side suspension used in a fall-arrest system. For example, such a system may be used by a user who is located on high scaffolding, cleaning windows on a high building. The CDD of the present invention may be used in conjunction with a safety lanyard (not shown) which may be connected on its distal end to a secure anchor on a structure and at its proximal end to a point on the CDD located on the back of the user, for example the back piece 12 of the harness.

After the fall, the user may have fallen off a scaffold and may hang suspended by the lanyard. The lanyard may have a pull-cord (not shown) which may be configured to release the lanyard from the user or to break the lanyard, thereby allowing the user to descend and for the CDD to begin its operation. In some embodiments, the drum device may be attached to straps configured to attach to a user's harness at a position near midriff or near the shoulders of the user, for example at the shoulder straps. In some embodiments a seating or reclining position is preferred when descending from a high structure such as a building, to allow a user to position the body and use the arms and legs to push away from the building to avoid injury while descending.

The various harness straps described hereinabove may be made from a durable strap material, such as, but not limited to, nylon, polyester, polypropylene webbing, or any other suitable material, and may comprise padding configured to be located on straps situated at the user's weight bearing areas. The straps may be about 3 to about 10 centimeters (cm) in width. In possible embodiments the straps may be attached to the back piece of the harness by looping through loops (not shown) provided in the harness back piece. In some embodiments at least some of the harness straps may be slidable through the harness back piece for adjustment.

The back piece, waist pieces, and the crotch support piece, may be fabricated from a woven natural or synthetic fiber, optionally having fire resistant properties, and may comprise light reflecting tape/stripes.

In some possible embodiments, in place of a friction brake shoe and drum braking system, a hydraulic circuit operatively connected to the spool to control the rate at which the cable reels out may be used. Alternatively, an electric generator/load circuit, induction system, fan or other energy dissipation apparatus may be used to control the speed of reeling out of the cable.

In some possible embodiments: the weight of a drum device and about 80 m of cable may be about 3 kilograms, the weight of a drum device and about 100 m of cable may be about 7.5 kilograms; the weight of a drum device and about 200 m of cable may 15 be about 12 kilograms. The drum devices having these weight ranges may be suitable weights for a user to lift and put on his or her back using a CDD according to embodiments of the invention.

The cable may be made from a fireproof material, such as a metal, for example, steel or synthetic material, and its length may be about 25-500 meters (m) and have a diameter of about 1 to about 4 millimeters (mm). Alternatively, the cable may be made of engineering plastics, Kevlar®, carbon fiber or other high strength cable material. The drum device used in the CDD of the present invention may be configured to reel out cable at a rate of about 1 to 2 meter per second when a weight of an average human (about 70 kg) descends while connected to the drum device and while an end of a cable is maintained in a fixed position.

In some embodiments one or more upper layers of the cable spooled inside the drum device over the cable reel are adhered (e.g., by hot glue) to prevent inadvertent release of the spooled cable before the CDD is used. For example, and without being limiting, about 1 to 2 meters of the spooled cable may be adhered by applying an adhesive material over the upper turns of the spooled cable.

As described hereinabove and shown in the associated Figs., the present invention provides harness systems and controlled descent devices usable for rescuing a user attempting to escape a high structure/building and quickly reach the ground, and related methods. While particular embodiments of the invention have been described, it will be understood, however, that the invention is not limited thereto, since modifications may be made by those skilled in the art, particularly in light of the foregoing teachings. As will be appreciated by the skilled person, the invention can be carried out in a great variety of ways, employing more than one technique from those described above, all without exceeding the scope of the invention.

The invention claimed is:

1. A harness for harnessing a user to a suspension or controlled decent device, the harness comprising:

an upper strap assembly comprising straps configured to wrap around upper and lateral sides of the user's torso, straps of said upper strap assembly having a back end for attachment to the suspension or controlled descent device at a back side of the harness, a lower strap assembly comprising straps configured to pass between the user's legs and wrap around a bottom side of the user's torso, and intermediary straps, each of said intermediary straps is attached by a front strap end thereof to at least one strap of said upper strap assembly at a front side of the harness, by a back strap end thereof to the suspension or controlled descent device at the back side of the harness, and at least one intermediate section between the front and back strap ends of said intermediary strap is attached to at least one strap of the lower strap assembly, thereby evenly distributing loads between the strap assemblies and substantially preventing suspension trauma to a harnessed user; and a connector assembly configured and operable to connect between front strap ends of one or more straps of said upper and lower strap assemblies at a front side of the harness.

2. The harness of claim 1 wherein the back strap ends of the straps connectable to the suspension or controlled descent device are configured to connect to a respective plurality of locations circumferentially distributed on a circumference of said suspension or controlled descent device.

3. The harness of claim 1 wherein straps of the upper strap assembly are attached to each other at the front side of the harness, using either permanent or adjustable connecting means, to thereby form two shoulder loops configured to receive shoulders of the user being harnessed.

4. The harness of claim 1 wherein the upper strap assembly comprises:

two abdomen straps extending in opposite directions from lateral sides of the back side of the harness, a front strap end of each abdomen strap being connectable to a connecting element of the connector assembly; and two spaced apart shoulder straps, each extending from an upper side of said back side of the harness and being attached to a respective abdomen strap by a front strap end thereof, to thereby form a shoulder loop configured to receive a shoulder of the user, back strap ends of said abdomen and shoulder straps being connectable to the suspension or controlled descent device.

5. The harness of claim 1 wherein the lower strap assembly comprises two spaced apart crotch straps extending from a bottom side of said back region, front strap ends of said crotch straps are connected to each other to thereby form a V-shaped structure having an apex, said apex being connectable to a connecting element of the connector assembly.

6. The harness of claim 4 wherein the lower strap assembly comprises two spaced apart crotch straps extending from a bottom side of said back region, front strap ends of said crotch straps are connected to each other to thereby form a V-shaped structure having an apex, said apex being connectable to a connecting element of the connector assembly, and each intermediary strap extends from a bottom side of the back region of the harness, the front strap end of said intermediary strap is attached to a respective abdomen strap of the upper strap assembly, and the at least one intermediate section of said intermediary strap is attached to a respective one of the crotch straps of said lower strap assembly.

7. The harness of claim 6 wherein each intermediary strap forms a V-shaped structure having an apex, said apex defining the at least one intermediate section of said intermediary strap that is attached to the respective crotch strap.

8. The harness of claim 6 comprising a suspension plate for mounting the suspension or controlled descent device thereon, said suspension plate comprising two side slots located at opposite lateral sides of the plate for connection of the back strap ends of the abdomen straps thereto, two spaced apart top slots located in an upper region of the plate for connection of the strap back ends of the shoulder straps thereto, and two spaced apart bottom slots located in a lower region of the plate for connection of the back straps ends of the intermediary straps thereto.

9. The harness device of claim 1 comprising a bag adapted to enclose the suspension or controlled descent device thereinside, said bag comprising a pocket with an opening at a bottom side of said bag, said pocket configured for holding straps of the lower strap assembly of the harness in an inoperable state of the harness.

10. The harness of claim 1 wherein the straps are configured to cause a forward nose-down tilt of the user harnessed to the suspension device.

11. The harness of claim 1 comprising adjustable strap connecting means for connecting the back strap ends to the suspension or controlled descent device.

12. A controlled descent device comprising:

a drum device having a cable spooled;

a harness having front and back sides and comprising:

an upper strap assembly comprising straps configured to wrap around upper and lateral sides of the user's torso, straps of said upper strap assembly having a back end connectable to the drum device at a back side of the harness, a lower strap assembly comprising straps configured to pass between the user's legs and wrap around a bottom side of the user's torso, and intermediary straps, each of said intermediary straps is attached by a front strap end thereof to at least one strap of said upper strap assembly at a front side of the harness, by a back strap end thereof to the drum device at the back side of the harness, and at least one intermediate section between the front and back strap ends of said intermediary strap is attached to at least one strap of the lower straps assembly, thereby evenly distributing loads between the straps and substantially preventing suspension trauma to an harnessed user; and a connector assembly configured and operable to connect between front strap ends of one or more straps of said upper and lower straps assemblies at a front side of the harness.

13. The device of claim 12 wherein the back strap ends of the straps connectable to the drum device are configured to connect to a respective plurality of locations circumferentially distributed on a circumference of said drum device.

14. The device of claim 12 wherein straps of the upper strap assembly are attached to each other at the front side of the harness, using either permanent or adjustable connecting means, to thereby form two shoulder loops configured to receive the shoulders of the user being harnessed.

15. The device of claim 12 wherein the upper strap assembly comprises:

two abdomen straps extending in opposite directions from lateral sides of the back side of the harness, a front strap end of each abdomen strap being connectable to a connecting element of the connector assembly; and two spaced apart shoulder straps, each extending from an upper side of the back side of said harness and being connectable to a respective abdomen strap by a front strap end thereof, to thereby form a shoulder loop configured to receive a shoulder of the user.

16. The device of claim 15 wherein the lower strap assembly comprises two spaced apart crotch straps extending from a bottom side of the back side of the harness, front strap ends of said crotch straps are connected to each other to form a V-shaped strap structure having an apex, said apex being connectable to a connecting element of the connector assembly.

17. The device of claim 16 comprising a suspension plate for mounting the drum device thereon, said suspension plate being connectable to the back strap ends connectable to the drum device at a plurality of locations circumferentially distributed on a circumference thereof.

18. The device of claim 17 wherein the suspension plate comprises two side slots located at the opposite lateral side of the plate for connection of the back strap ends of the abdomen straps thereto, two spaced apart top slots located in an upper region of the plate for connection of the back strap ends of the shoulder straps thereto, and two spaced apart bottom slots located in a lower region of the plate for connection of the back strap ends of the intermediary straps thereto.

19. The device of claim 18 wherein the controlled descent device comprises the drum device secured to the suspension plate and configured and operable to control a rate of release of the cable spooled inside said drum device, to thereby provide a desired profile of the rate of descent.

20. The device of claim 19 wherein the drum device comprises: a housing and a cable reel rotatably mounted thereinside, the cable being spooled over said reel; an anchor fastener connected to a free end of said cable; and a brake mechanism inside the housing configured and operable to control the rate of release of the spooled cable.

21. The device of claim 12 comprising adjustable strap connecting means for connecting the back strap ends to the drum device.

* * * * *